US011352684B2

(12) United States Patent
Tabata et al.

(10) Patent No.: US 11,352,684 B2
(45) Date of Patent: Jun. 7, 2022

(54) STEEL MEMBER, STEEL SHEET, AND METHODS FOR MANUFACTURING SAME

(71) Applicant: NIPPON STEEL CORPORATION, Tokyo (JP)

(72) Inventors: Shinichiro Tabata, Tokyo (JP); Kazuhisa Kusumi, Tokyo (JP); Kazuo Hikida, Tokyo (JP); Hideaki Irikawa, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 17/292,308

(22) PCT Filed: Feb. 5, 2020

(86) PCT No.: PCT/JP2020/004421
§ 371 (c)(1),
(2) Date: May 7, 2021

(87) PCT Pub. No.: WO2020/162509
PCT Pub. Date: Aug. 13, 2020

(65) Prior Publication Data

US 2021/0395870 A1 Dec. 23, 2021

(30) Foreign Application Priority Data

Feb. 5, 2019 (JP) ..... JP2019-019077

(51) Int. Cl.

| | |
|---|---|
| ***C22C 38/58*** | (2006.01) |
| ***C21D 8/02*** | (2006.01) |
| ***C21D 9/46*** | (2006.01) |
| ***C22C 38/00*** | (2006.01) |
| ***C22C 38/02*** | (2006.01) |

(Continued)

(52) U.S. Cl.
CPC ..... *C22C 38/58* (2013.01); *C21D 8/0205* (2013.01); *C21D 8/0226* (2013.01); *C21D 9/46* (2013.01); *C22C 38/002* (2013.01); *C22C 38/005* (2013.01); *C22C 38/008* (2013.01); *C22C 38/02* (2013.01); *C22C 38/06* (2013.01); *C22C 38/42* (2013.01); *C22C 38/44* (2013.01);
(Continued)

(58) Field of Classification Search
None
See application file for complete search history.

(56) References Cited

U.S. PATENT DOCUMENTS

2005/0121119 A1 6/2005 Hasegawa et al.
2012/0321903 A1 12/2012 Nakamaru et al.
(Continued)

FOREIGN PATENT DOCUMENTS

EP 3 399 064 A1 11/2018
JP 2002-102980 A 4/2002
(Continued)

*Primary Examiner* — Jenny R Wu
(74) *Attorney, Agent, or Firm* — Birch, Stewart, Kolasch & Birch, LLP

(57) ABSTRACT

The present invention has as its object the provision of a steel member and steel sheet having high tensile strength and toughness and excellent in hydrogen embrittlement resistance in a corrosive environment and methods for manufacturing the same. The steel member of the present invention has predetermined chemical constituents and has a maximum value of content of Cu in a range from the surface to a depth of 0 to 30 μm of 1.4 times the content of Cu at a depth of 200 μm.

6 Claims, 1 Drawing Sheet

(51) Int. Cl.

| | |
|---|---|
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |

(52) U.S. Cl.
CPC ..... *C22C 38/46* (2013.01); *C22C 38/48* (2013.01); *C22C 38/50* (2013.01); *C22C 38/54* (2013.01)

(56) References Cited

U.S. PATENT DOCUMENTS

| | | | |
|---|---|---|---|
| 2017/0253941 | A1 | 9/2017 | Cobo et al. |
| 2019/0040490 | A1 | 2/2019 | Yoshioka et al. |
| 2019/0249268 | A1 | 8/2019 | Nakagawa et al. |

FOREIGN PATENT DOCUMENTS

| | | | |
|---|---|---|---|
| JP | 2003-268489 | A | 9/2003 |
| JP | 2010-111950 | A | 5/2010 |
| JP | 2011-122207 | A | 6/2011 |
| JP | 2011-246801 | A | 12/2011 |
| JP | 2012-1802 | A | 1/2012 |
| JP | 2012-1816 | A | 1/2012 |
| JP | 2012-180594 | A | 9/2012 |
| JP | 2015-113500 | A | 6/2015 |
| JP | 2017-525849 | A | 9/2017 |
| JP | 2017-179589 | A | 10/2017 |
| KR | 10-2009-0071163 | A | 7/2009 |
| WO | WO 2017/141952 | A1 | 8/2017 |
| WO | WO 2017/141953 | A1 | 8/2017 |

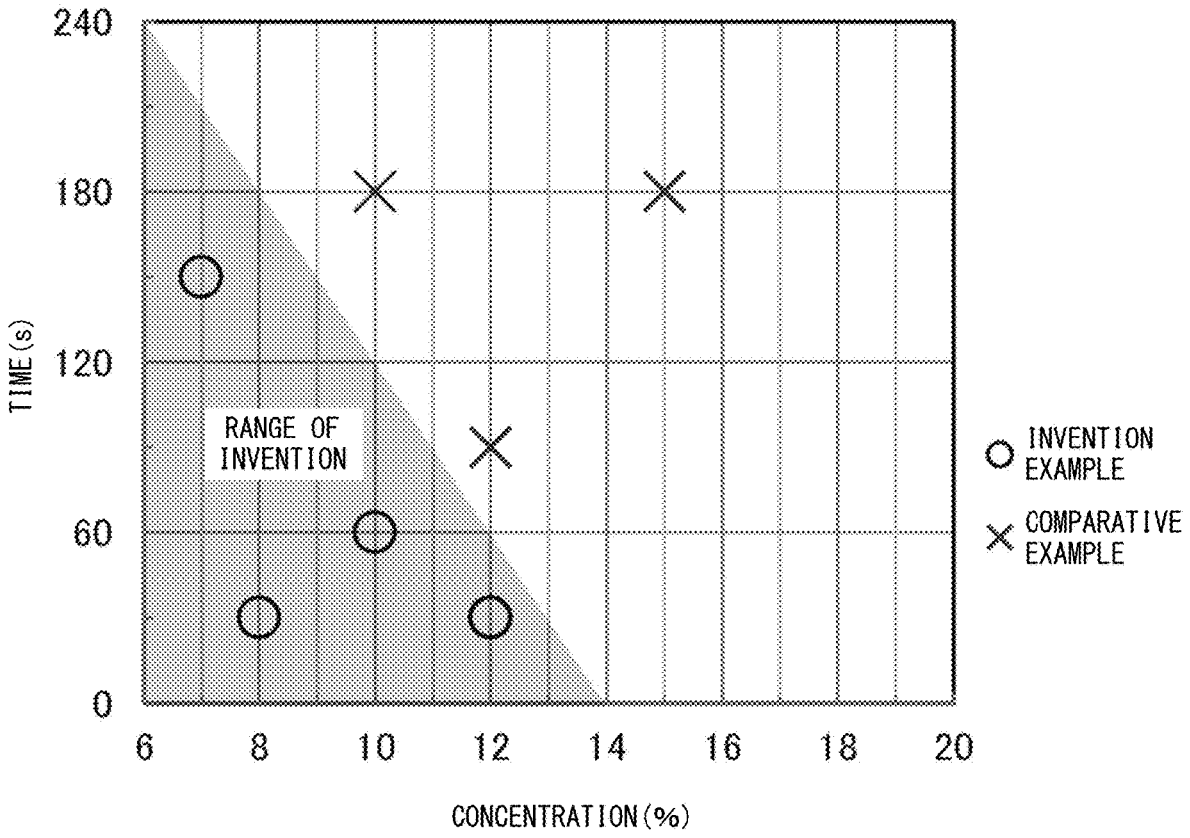
240
180
120
60
0
TIME(s)
6
8
10
12
14
16
18
20
CONCENTRATION(%)
RANGE OF INVENTION
INVENTION EXAMPLE
COMPARATIVE EXAMPLE

STEEL MEMBER, STEEL SHEET, AND METHODS FOR MANUFACTURING SAME

FIELD

The present invention relates to a steel member, steel sheet, and methods for manufacturing the same.

BACKGROUND

In the field of steel sheets for automobile use, due to the recent increasing severity of environmental regulations and collision safety standards, applications of steel sheet having high tensile strength are increasing so as to achieve both fuel efficiency and collision safety. However, along with the higher strength, the press formability of steel sheet falls, so it has become difficult to manufacture products with complicated shapes.

Specifically, due to the drop in ductility of steel sheet accompanying higher strength, the problem arises of fracture of the highly worked portions. Further, due to the residual stress after working, the problems arise that springback and wall camber occur and the dimensional precision deteriorates. Therefore, it is not easy to press form steel sheet having a high strength, in particular a tensile strength of 780 MPa or more, into a product having a complicated shape. Note that, if using not press forming, but roll forming, high strength steel sheet is easily worked, but applications have been limited to parts having uniform cross-sections in the longitudinal direction.

Therefore, in recent years, for example, as disclosed in PTLs 1 to 3, hot stamping has been employed as art for press-forming materials which are difficult to shape such as high strength steel sheet. Hot stamping is a hot forming technology for heating a material before shaping, then shaping the material.

In this art, the material is heated, then shaped, so at the time of shaping, the steel material is soft and has good shapeability. Due to this, even if a high strength steel material, it is possible to precisely form it into a complicated shape. Further, in hot stamping, a press die is used for hardening during shaping, so after the shaping, the steel material has sufficient strength. Further, the strain introduced by shaping is eliminated by transformation at the time of hardening, so after shaping, the steel material is also excellent in toughness.

For example, according to PTL 1, hot stamping can be used to impart a tensile strength of 1400 MPa or more to a steel material after shaping.

CITATIONS LIST

Patent Literature

[PTL 1] Japanese Unexamined Patent Publication No. 2002-102980

[PTL 2] Japanese Unexamined Patent Publication No. 2012-180594

[PTL 3] Japanese Unexamined Patent Publication No. 2012-1802

[PTL 4] Japanese Unexamined Patent Publication No. 2003-268489

[PTL 5] Japanese Unexamined Patent Publication No. 2017-179589

[PTL 6] Japanese Unexamined Patent Publication No. 2015-113500

[PTL 7] Japanese Unexamined Patent Publication No. 2017-525849

[PTL 8] Japanese Unexamined Patent Publication No. 2011-122207

[PTL 9] Japanese Unexamined Patent Publication No. 2011-246801

[PTL 10] Japanese Unexamined Patent Publication No. 2012-1816

SUMMARY

Technical Problem

At the present time, along with the establishment of challenging fuel efficiency targets in various countries, further higher strength steel materials are being demanded for lightening the weight of car bodies. Specifically, high strength steel materials of over the general strength of 1.5 GPa in hot stamping are considered necessary.

In this regard, if applying high strength steel materials of over a strength of 1 GPa to automobiles, not only the above-mentioned shapeability and toughness after shaping, but also hydrogen embrittlement resistance is demanded. If the hydrogen embrittlement resistance of high strength steel sheet is not sufficient, after an automobile is shipped to the market, the steel will corrode during use by the general user and the hydrogen generated along with the corrosion reaction may cause embrittlement cracking.

In a region over a strength of 1.5 GPa, the sensitivity of a steel material to hydrogen embrittlement rapidly increases, so hydrogen embrittlement cracking is a concern even at portions with light corrosion. Therefore, to commercially apply high strength steel materials of over 1.5 GPa to car bodies, art is necessary for providing a steel member excellent in hydrogen embrittlement resistance in a corrosive environment.

Regarding high strength steel materials of over 1.5 GPa, for example, PTL 2 discloses a press formed article excellent in toughness and having a tensile strength of 1.8 GPa or more which is formed by hot pressing. However, the measures against hydrogen embrittlement in a corrosive environment are not sufficient. In use as an automobile member, sometimes greater safety demands are not answered.

Further, PTL 3 discloses a steel material having an extremely high tensile strength of 2.0 GPa or more and further having excellent toughness and ductility. However, the measures against hydrogen embrittlement in a corrosive environment are not sufficient. In use as an automobile member, sometimes greater safety demands are not answered.

Regarding hydrogen embrittlement resistance, for example, PTLs 4, 5, and 6 show hot stamped materials excellent in hydrogen embrittlement resistance in a hydrochloric acid immersion environment. However, in an air corrosive environment at the time of automobile use, as explained later, pitting causes hydrogen embrittlement to more easily occur due to a hydrochloric acid immersion environment. These materials are insufficient for use of high strength materials of over 1.5 GPa for a car body like the present invention.

Further, PTL 7 shows a hot stamping material with the Ni in the steel concentrated at the surface layer and describes that this has the effect of suppressing hydrogen penetration in the hot stamping process. However, there is no description relating to the hydrogen embrittlement resistance in a corrosive environment at the time of use of an automobile. This is insufficient for use of a high strength material of over 1.5 GPa for a car body.

Further, PTLs 8, 9, and 10 show hot stamping materials in which Ni diffuses from a Ni-based plating layer to the surface layer of the steel sheet and describes that this has the effect of suppressing hydrogen penetration in a corrosive environment. However, as explained later, it is not possible to decrease the amount of pitting forming starting points for hydrogen embrittlement cracking. Even if reducing hydrogen penetration, there is a high risk of hydrogen concentrating at the pitting and causing hydrogen embrittlement cracking.

The present invention was made so as to solve the above problem and has as its object the provision of a steel member and steel sheet having high tensile strength and toughness and excellent in hydrogen embrittlement resistance in a corrosive environment and methods for manufacturing the same.

Technical Problem

The present invention has as its gist the following steel member, steel sheet, and methods for manufacturing the same.

(1) A steel member, a chemical composition of the steel member comprising, by mass %, C: 0.25 to 0.60%, Si: 0.25 to 2.00%, Mn: 0.30 to 3.00%, P: 0.050% or less, S: 0.0100% or less, N: 0.010% or less, Ti: 0.010 to 0.100%, B: 0.0005 to 0.0100%, Cu: 0.15 to 1.00%, Mo: 0.10 to 1.00%, Cr: 0 to 1.00%, Ni: 0 to 1.00%, V: 0 to 1.00%, Ca: 0 to 0.010%, Al: 0 to 1.00%, Nb: 0 to 0.10%, Sn: 0 to 1.00%, W: 0 to 1.00%, Sb: 0 to 1.00%, REMs: 0 to 0.30%, and bal.: Fe and impurities, a maximum value of the content of Cu in a range of a depth from the surface of 0 to 30 μm being 1.4 times or more of the content of Cu at a depth of 200 μm.

(2) A steel sheet, a chemical composition of the steel sheet comprising, by mass %, C: 0.25 to 0.60%, Si: 0.25 to 2.00%, Mn: 0.30 to 3.00%, P: 0.050% or less, S: 0.0100% or less, N: 0.010% or less, Ti: 0.010 to 0.100%, B: 0.0005 to 0.0100%, Cu: 0.15 to 1.00%, Mo: 0.10 to 1.00%, Cr: 0 to 1.00%, Ni: 0 to 1.00%, V: 0 to 1.00%, Ca: 0 to 0.010%, Al: 0 to 1.00%, Nb: 0 to 0.10%, Sn: 0 to 1.00%, W: 0 to 1.00%, Sb: 0 to 1.00%, REMs: 0 to 0.30%, and bal.: Fe and impurities, a maximum value of the content of Cu in a range of a depth from the surface of 0 to 30 μm being 1.2 times or more of the content of Cu at a depth of 200 μm, an average crystal grain size being 30 μm or less.

(3) A method for manufacturing the steel sheet of (2), the method comprising the steps of: heating a slab having constituents described in (2) to 1100 to 1350° C. and hot rolling the heated slab to obtain a hot rolled steel sheet under conditions of a time t1 (hr) from the end of rough rolling to the start of finish rolling and an average temperature T1 (° C.) of a rough bar from the end of rough rolling to the start of finish rolling satisfying $(T1+273)\times(\log t1+20)\geq 20000$ and a finish rolling end temperature of an $Ar_3$ point to 1000° C., cooling the hot rolled steel sheet by an average cooling rate of 10° C./s or more, coiling the steel sheet after cooling at 700° C. or less, and pickling the steel sheet after coiling.

(4) The method of (3), wherein in the step of pickling, hydrochloric acid or sulfuric acid is used, a pickling temperature is 80 to 90° C., and an acid concentration α (%) and pickling time "t" (s) satisfy $6\leq\alpha<14$ and $0<t\leq 420-30\times\alpha$ (5) A method for manufacturing the steel member of (1), the method comprising the steps of: heating the steel sheet of (2) under conditions of a peak temperature of T2 (° C.) and a time from when a temperature of the steel sheet reaches a temperature 10° C. lower than T2 (° C.) until heating ends of t2 (hr) satisfying $(T2+273-10)\times(\log t2+20)\geq 19000$, $Ac_3$ point$\leq T2\leq(Ac_3$ point$+300°)$ C., and an average rate of temperature rise of 5 to 1000° C./s; cooling the heated steel sheet down to an Ms point by an upper critical cooling rate or more; and cooling from the Ms point to 100° C. or less by an average cooling rate of 5° C./s or more.

(6) The method of (5), wherein the steel sheet is hot shaped during cooling the steel sheet down to the Ms point.

Advantageous Effects of Invention

According to the present invention, it is possible to provide a steel member and steel sheet having high tensile strength and excellent in hydrogen embrittlement resistance in a corrosive environment and methods for manufacturing the same.

BRIEF DESCRIPTION OF DRAWINGS

FIG. 1 is a view showing the relationship between acid concentration and time in pickling in the present invention.

DESCRIPTION OF EMBODIMENTS

First, details of studies by the inventors in investigating the effects of the chemical constituents and structure on properties so as to obtain a steel member excellent in hydrogen embrittlement resistance in a corrosive environment will be explained.

Most steel sheets for hot stamping use are similar in constituents. They generally contain C: 0.2 to 0.3% or so and Mn: 1 to 2% or so and further contain B. Further, in the heat treatment process, steel sheet having such constituents is heated to the $Ac_3$ point or higher temperature, then quickly conveyed so that the ferrite does not precipitate and rapidly cooled by a die press until the martensite transformation start temperature (Ms point) to thereby obtain a high strength steel member having a tensile strength of 1.5 GPa or so.

A general use hot stamping material has the risk of hydrogen embrittlement cracking in a corrosive environment, so is difficult to apply to a lower part of an automobile where corrosion is severe. Further, hot stamping materials with tensile strengths over 1.5 GPa have begun being produced for lightening the weight of automobiles, but if the tensile strength becomes high, the susceptibility to hydrogen embrittlement rises, so the risk of hydrogen embrittlement cracking becomes higher even at parts of automobiles with light corrosion.

(a) The inventors investigated in detail the mechanism of hydrogen embrittlement cracking in a corrosive environment and as a result learned that in an air corrosive environment such as in which automobiles are used, corrosion proceeds not completely uniformly, but unevenly and stress concentrates and hydrogen collects at the pitting parts whereby hydrogen embrittlement cracking is aggravated.

(b) Further, the inventors tackled the suppression of pitting based on the above mechanism of hydrogen embrittlement cracking in a corrosive environment. As a result, they discovered that by adding Cu into the steel sheet, pitting can be greatly suppressed and the hydrogen embrittlement resistance in a corrosive environment can be strikingly improved.

(c) Furthermore, the inventors engaged in detailed tests to verify the above effect of Cu and as a result learned that if excessively adding Cu, the toughness of the steel material and the critical amount of hydrogen (critical amount of hydrogen where the steel material does not crack by hydrogen embrittlement in a state of no concentration of stress and buildup of hydrogen due to pitting) fall. Therefore, they discovered that by making Cu concentrate at the surface at the time of manufacturing of the steel sheet material and the time of heat treatment of the steel member, it becomes possible to keep the deterioration of toughness and the critical amount of hydrogen to a minimum while improving the hydrogen embrittlement resistance in a corrosive environment by a suitable amount of Cu.

The present invention was made based on the above findings. Below, the requirements of the steel member, steel sheet, and methods for manufacturing the same according to one embodiment of the present invention will be explained in detail.

(A) Steel Member (A1) Chemical Composition of Steel Member

The reasons for limitation of the elements of the steel member are as follows. Note that, in the following explanation, the "%" regarding the contents mean "mass %". Here, the "chemical composition of the steel member" shall mean the average chemical composition of the steel member.

C: 0.25 to 0.60%

C is an element which raises the hardenability of steel and improves the strength of the steel member after hardening. However, with a content of C of less than 0.25%, it becomes difficult to secure sufficient strength in the steel member after hardening. Therefore, the content of C is made 0.25% or more. On the other hand, if the content of C is over 0.60%, the strength of the steel member after hardening becomes too high and the toughness and hydrogen embrittlement resistance remarkably deteriorate. Therefore, the content of C is made 0.60% or less. The content of C is preferably 0.29% or more or 0.31% or more and is preferably 0.50% or less, 0.48% or less, or 0.44% or less.

Si: 0.25 to 2.00%

Si is an element which is effective for raising the hardenability of steel and stably securing the strength after hardening. To obtain this effect, Si must be included in 0.25% or more. However, if the content of Si in the steel is over 2.00%, at the time of heat treatment, the heating temperature required for austenite transformation becomes remarkably high. Due to this, sometimes a rise in costs required for heat treatment is invited. Furthermore, a deterioration of toughness of the hardened part is invited. Therefore, the content of Si is made 2.00% or less. The content of Si is preferably 0.30% or more or 0.35% or more and is preferably 1.60% or less, 1.00% or less, 0.80% or less, or 0.60% or less.

Mn: 0.30 to 3.00%

Mn is an element which is extremely effective for raising the hardenability of steel sheet and stably securing the strength after hardening. Furthermore, it is an element lowering the $Ac_3$ point and promoting lowering of the hardening treatment temperature. However, if the content of Mn is less than 0.30%, this effect is not sufficiently obtained. On the other hand, if the content of Mn is over 3.00%, the above effect becomes saturated and a deterioration of toughness or hydrogen embrittlement resistance of the hardened part is invited. Therefore, the content of Mn is made 0.30 to 3.00% or less. The content of Mn is preferably 0.40% or more, 0.50% or more, or 0.60% or more. Further, the content of Mn is preferably 2.80% or less or 2.00%, more preferably 1.50% or less, 1.20%, or 0.90% or less.

P: 0.050% or Less

P is an element causing a deterioration of toughness or hydrogen embrittlement resistance of the steel member after hardening. In particular, if the content of P is over 0.050%, the deterioration of toughness or hydrogen embrittlement resistance becomes remarkable. Therefore, the content of P is limited to 0.050% or less. The content of P is preferably limited to 0.020% or less, 0.010% or less, or 0.005% or less. The lower limit of the content of P is 0%. For reducing the refining costs, the lower limit of the content of P may be made 0.0001% or 0.001%.

S: 0.0100% or Less

S is an element causing a deterioration of toughness or hydrogen embrittlement resistance of the steel member after hardening. In particular, if the content of S is over 0.0100%, the deterioration of toughness or hydrogen embrittlement resistance becomes remarkable. Therefore, the content of S is limited to 0.0100% or less. The content of S is preferably limited to 0.0070% or 0.0050% or less. The lower limit of the content of S is 0%. For reducing the steelmaking costs for reducing the content of S, the lower limit of the content of S may be made 0.0001% or 0.0005%.

N: 0.010% or Less

N is an element causing a deterioration of toughness of the steel member after hardening. In particular, if the content of N is over 0.010%, coarse nitrides are formed in the steel and the toughness remarkably deteriorates. Therefore, the content of N is made 0.010% or less. The lower limit of the content of N is 0%. Reducing the content of N to less than 0.0002% invites an increase in steelmaking costs and is not economically preferable, so the content of N is preferably made 0.0002% or more, more preferably 0.0008% or more.

Ti: 0.010 to 0.100%

Ti is an element having the action of suppressing recrystallization when heating steel sheet to the $Ac_3$ point or more in temperature to heat treat it and of forming fine carbides to suppress grain growth and thereby make the austenite grains finer. For this reason, by including Ti, the effect is obtained of the toughness of the steel member greatly being improved. Further, Ti bonds with the N in the steel with priority to thereby suppress the consumption of B by precipitation of BN and promotes the effect of improvement of hardenability due to B explained later. With a content of Ti of less than 0.010%, the above effect is not sufficiently obtained. Therefore, the content of Ti is made 0.010% or more. On the other hand, if the content of Ti is over 0.100%, the amount of precipitation of TiC increases and C is consumed, so the strength of the steel member after hardening falls. Therefore, the content of Ti is made 0.100% or less. The content of Ti is preferably 0.015% or more or 0.025% or more and preferably 0.080% or less or 0.045% or less.

B: 0.0005 to 0.0100%

B, even in fine amounts, has the action of dramatically raising the hardenability of steel, so is an important element in the present invention. Further, B precipitates at the grain boundaries to thereby strengthen the grain boundaries and improve the toughness and hydrogen embrittlement resistance. Furthermore, B suppresses grain growth of austenite at the time of heating the steel sheet. With a content of B of less than 0.0005%, the above effect sometimes cannot be sufficiently obtained. Therefore, the content of B is made 0.0005% or more. On the other hand, if the content of B is over 0.0100%, coarse compounds precipitate in large amounts and the toughness or hydrogen embrittlement resistance of the steel member deteriorates. Therefore, the content of B is made 0.0100% or less. The content of B is preferably 0.0010% or more, 0.0015% or more, or 0.0020% or more and preferably 0.0050% or less or 0.0030% or less.

Cu: 0.15 to 1.00%

Cu suppresses pitting in a corrosive environment and prevents hydrogen embrittlement cracking, so is an extremely important element in the present invention. Furthermore, Cu is an element able to raise the hardenability of steel and stably secure the strength of the steel member after hardening. However, with a content of Cu of less than 0.15%, that effect is not sufficiently obtained. On the other hand, if the content of Cu is over 1.00%, that effect becomes saturated and furthermore deterioration of the toughness or hydrogen embrittlement resistance of the steel member after hardening is invited. For this reason, the content of Cu is made 0.15 to 1.00%. The content of Cu is preferably 0.18% or more or 0.20% or more. Further, the content of Cu is preferably 0.80% or less, 0.50% or less, or 0.35% or less.

Mo: 0.10 to 1.00%

Mo is an element which is extremely effective for raising the hardenability of steel sheet and stably securing the strength after hardening. Further, Mo precipitates at the grain boundaries to thereby strengthen the grain boundaries and improve the toughness or hydrogen embrittlement resistance. However, if the content of Mo is less than 0.10%, this effect is not sufficiently obtained. On the other hand, if the content of Mo is over 1.00%, the above effect becomes saturated and the economicalness falls. Further, Mo has the action of stabilizing the iron carbides, so if the content of Mo is over 1.00%, coarse iron carbides remain without being melted at the time of heating the steel sheet and the toughness of the steel member after hardening deteriorates. Therefore, the content of Mo if included is made 1.0% or less. The content of Mo is preferably 0.15% or more or 0.19% or more and is preferably 0.80% or less, 0.50% or less, or 0.30% or less.

The steel member of the present embodiment may further be made to include, in addition to the above elements, one or more elements selected from Cr, Ni, V, Ca, Al, Nb, Sn, W, Sb, and REMs shown below. Further, these elements need not be included either. The lower limits of the contents of these elements are all 0%.

Cr: 0 to 1.00%

Cr is an element able to raise the hardenability of steel and stably secure the strength of the steel member after hardening, so may be included. However, if the content of Cr is over 1.00%, that effect becomes saturated and an increase in costs is needlessly invited. Further, Cr has the action of stabilizing the iron carbides, so if the content of Cr is over 1.00%, coarse iron carbides remain without being melted at the time of heating the steel sheet and the toughness of the steel member after hardening deteriorates. Therefore, the content of Cr if included is made 1.00% or less. The content of Cr is preferably 0.80% or less or 0.50% or less. To obtain the above effect, the content of Cr is more preferably 0.01% or more or 0.05% or more. If the above effect does not have to be obtained, it may be made 0.05% or less or 0.01% or less.

Ni: 0 to 1.00%

Ni is an element which raises the hardenability of steel and stably secures the strength of the steel member after hardening, so may be contained. However, if the content of Ni is over 1.00%, the above effect becomes saturated and the economicalness falls. Therefore, the content of Ni if included is made 1.00% or less. The content of Ni may be made 0.80% or less or 0.50% or less. To obtain the above effect, Ni is preferably contained in 0.01% or more, more preferably is contained in 0.10% or more.

V: 0 to 1.00%

V is an element able to form fine carbides and raise the toughness due to the grain refining effect, so may be included. However, if the content of V is over 1.00%, the above effect becomes saturated and the economicalness falls. Therefore, the content of V if included is made 1.00% or less. To obtain the above effect, V is preferably included in 0.01% or more, more preferably is included in 0.10% or more. If the above effect does not have to be obtained, it may be made 0.10% or less or 0.01% or less.

Ca: 0 to 0.010%

Ca is an element which has the effect of refining inclusions in the steel and improving the toughness after hardening, so may be included. However, if the content of Ca is over 0.010%, that effect is saturated and an increase in costs is needlessly invited. Therefore, in containing Ca, the content is made 0.010% or less. The content of Ca is preferably 0.005% or less, more preferably 0.004% or less. If desiring to obtain the above effect, the content of C is preferably made 0.001% or more, more preferably is made 0.002% or more. If the above effect does not have to be obtained, it may be made 0.002% or less or 0.001% or less.

Al: 0 to 1.00%

Al is generally used as a deoxidizer of steel, so may be included. However, if the content of Al (however, not content of sol-Al, but content of T-Al) is over 1.00%, the above effect becomes saturated and the economicalness falls. Therefore, the content of Al if included is made 1.00% or less. The content of Al may be 0.10% or less or 0.05% or less. To obtain the above effect, Al is preferably included in 0.01% or more. If the above effect does not have to be obtained, it may be made 0.01% or less.

Nb: 0 to 0.10% Nb is an element able to form fine carbides and raise the toughness due to the grain refining effect, so may be included. However, if the content of Nb is over 0.10%, the above effect becomes saturated and the economicalness falls. Therefore, the content of Nb if included is made 0.10% or less. The content of Nb may also be made 0.06% or less or 0.04% or less. To obtain the above effect, Nb is preferably included in 0.01% or more. If the above effect does not have to be obtained, it may be made 0.01% or less.

Sn: 0 to 1.00%

Sn improves the corrosion resistance in a corrosive environment, so may be contained. However, if the content of Sn is over 1.00%, the intergranular strength falls and the toughness of the steel member after hardening deteriorates. Therefore, the content of Sn if included is made 1.00% or less. The content of Sn may be made 0.50% or less, 0.10%, or 0.04% or less. To obtain the above effect, Sn is preferably contained in 0.01% or more. If the above effect does not have to be obtained, it may be made 0.01% or less.

W: 0 to 1.00%

W is an element which raises the hardenability of steel and stably secures the strength of the steel member after hardening, so may be contained. Further, W improves the corrosion resistance in a corrosive environment. However, if the content of W is over 1.00%, the above effect becomes saturated and the economicalness falls. Therefore, the content of W if included is made 1.00% or less. The content of W may be made 0.50% or less, 0.10%, or 0.04% or less. To obtain the above effect, W is preferably contained in 0.01% or more. If the above effect does not have to be obtained, it may be made 0.01% or less.

Sb: 0 to 1.00%

Sb improves the corrosion resistance in a corrosive environment, so may be included. However, if the content of Sb is over 1.00%, the intergranular strength falls and the toughness of the steel member after hardening deteriorates. Therefore, the content of Sb if included is made 1.00% or less. The content of Sb may also be made 0.50% or less or 0.10% or 0.04% or less. To obtain the above effect, Sb is preferably contained in 0.01% or more. If the above effect does not have to be obtained, it may be made 0.01% or less.

REMs: 0 to 0.30%

REMs are elements having the effect, like Ca, of refining inclusions in the steel and improving the toughness of the steel member after hardening, so may be included. However, if the content of REMs is over 0.30%, that effect becomes saturated and an increase in costs is needlessly invited. Therefore, the content of REMs if included is made 0.30% or less. The content of REMs is preferably 0.20% or less or 0.05% or less. If desiring to obtain the above effect, the content of REMs is preferably made 0.01% or more, more preferably is made 0.02% or more. If the above effect does not have to be obtained, it may be made 0.01% or less or 0.0010% or less.

Here, "REMs" indicates a total of 17 elements including Sc, Y, La, Nd, and other lanthanoids. The above "content of REMs" means the total content of these elements. REMs are added to the molten steel for example using Fe—Si-REM alloys. The alloys contain for example Ce, La, Nd, and Pr.

In the chemical compositions of the steel member and steel sheet of the present embodiment, the remainders other than the elements explained above, that is, the balances, are comprised of Fe and impurities.

Here, "impurities" mean constituents which enter from the ore, scraps, and other raw materials and various factors in the manufacturing process when industrially manufacturing steel sheet and are allowable in a range not having a detrimental effect on the present invention.

(A2) Structure of Steel Member

The steel member according to the present embodiment has a metallic structure with a maximum value of the content of Cu within a depth of 30 μm from the surface of 1.4 times or more the content of Cu at a depth of 200 μm from the surface.

Degree of Surface Concentration of Cu: 1.4 or More

The Cu concentrated at the surface of the steel member has the effect of forming a dense rust layer at the time of use of the member to thereby suppress pitting and improve the hydrogen embrittlement resistance in a corrosive environment. On the other hand, if excessively adding Cu, the toughness of the steel member or critical amount of hydrogen deteriorates. Therefore, by making a suitable amount of Cu concentrate at the surface, it is possible to prevent deterioration of the toughness of the steel member or the critical amount of hydrogen while improving the hydrogen embrittlement resistance. In particular, if the degree of surface concentration of Cu is less than 1.4, the pitting tendency of the surface increases and the risk of hydrogen embrittlement rises along with corrosion. Therefore, the degree of surface concentration of Cu is made 1.4 or more. Preferably, it is 1.6% or more. It is not necessary to prescribe an upper limit of the degree of surface concentration of Cu, but it may be made 2.5 or 2.1.

The degree of surface concentration of Cu is found in the following way:

GDS (glow discharge optical emission spectrometry) is performed in the thickness direction from the surface of the steel member to detect the content of Cu. At this time, the value of the maximum value of the content of Cu in a range of a depth of 0 to 30 μm from the surface divided by the content of Cu at a depth of 200 μm from the surface is calculated and that value is used as the degree of surface concentration of Cu.

Note that for the measurement by GDS, the maximum value of the content of Cu in a range of a depth of 0 to 30 μm from the surface and the content of Cu at a depth of 200 μm from the surface were measured at five random positions at positions near ¼ of the sheet width from an end of the steel member in the width direction to calculate the degree of surface concentration of Cu. The degree of surface concentration of Cu in the present invention is made the average value of the degrees of surface concentration of Cu at these five positions. However, if the surface of the steel member is covered by an oxide film or oxide scale, GDS is performed from the surface of the steel member, the position of a depth where the content of Fe becomes 80% is deemed the surface, and the value of the maximum value of the content of Cu in a range of a depth of 0 to 30 μm from the surface divided by the content of Cu at the 200 μm position is calculated to find the degree of surface concentration of Cu. Further, if the surface of the steel member is electroplated, hot dip coated, or otherwise treated, GDS is performed from the surface of the steel member and the position of a depth where the content of Fe becomes 90% is deemed the surface. Note that, if the surface of the steel member is covered by an oxide film or oxide scale, relief shapes are formed at the interface of these and steel, so compared with the case of plating etc., the position where the content of Fe is a somewhat smaller 80% is deemed as the surface and the value of the maximum value of the content of Cu in a range of a depth of 0 to 30 μm from that position divided by the content of Cu at a depth of 200 μm from that position is calculated to find the degree of surface concentration of Cu.

Further, the structure present in the present embodiment is a structure mainly comprised of high strength martensite. 70% or more by area ratio is preferably martensite. More preferably, it is 80% or more, still more preferably 90% or more, 95% or more, or 100%.

As the balance, residual austenite, bainite, ferrite, and pearlite may be contained. Note that, the above-mentioned martensite also includes tempered or auto-tempered martensite. Auto-tempered martensite is martensite formed during the cooling at the time of hardening without performing heat treatment for tempering and is formed by the martensite formed being tempered on the spot by the heat generated along with martensite transformation.

(A3) Properties of Steel Member

The steel member of the present embodiment can be given excellent hydrogen embrittlement resistance in a corrosive environment due to the effect in suppressing pitting of the Cu concentrated at its surface. However, excessive addition of Cu detracts from the toughness of the steel member or critical amount of hydrogen (critical amount of hydrogen where the steel material does not crack by hydrogen embrittlement in a state with no concentration of stress and buildup of hydrogen due to pitting), so this is made to concentrate at the surface by the method of manufacture explained later by addition in the above-mentioned suitable amount.

Further, the steel member according to the present embodiment desirably not only has hydrogen embrittlement resistance in a corrosive environment, but also has a high strength of a tensile strength over 1500 MPa and has a high toughness and critical amount of hydrogen where hydrogen embrittlement does not occur.

In the present embodiment, the hydrogen embrittlement resistance in a corrosive environment is evaluated by an exposure test in an actual environment of the steel member or an accelerated corrosion test using CCT (cyclic corrosion test). As the accelerated corrosion test, for example, the steel member is bent while supported at four points, subjected to a CCT based on the neutral salt spray cyclic test method described in JIS H 8502: 1999, and evaluated by the critical number of cycles where hydrogen embrittlement cracking does not occur.

In the present embodiment, the toughness is evaluated by an impact test or notch impact test of the steel member. For example, a V-notched Charpy impact test piece is cut out from the steel member, subjected to a Charpy impact test based on the provision of JIS Z 2242: 2018, and evaluated for toughness by the impact value (absorption energy) at −40° C.

In the present embodiment, the above critical amount of hydrogen is evaluated by bending the above steel member supported at four points, charging hydrogen by thiocyanic acid immersion, and finding the critical amount of hydrogen where no cracking occurs within a predetermined time. The method for measurement of the critical amount of hydrogen will be explained in detail in the section on examples.

Above, the steel member according to the present embodiment was explained, but the shape of the steel member is not particularly limited. That is, it may be a flat sheet, but in particular hot shaped steel members are in many cases shaped articles. In the present embodiment, both the case of a shaped member and the case of a flat sheet will be referred to together as a "steel member". The thickness of the steel member does not particularly have to be prescribed, but may be 0.5 to 5.0 mm. The upper limit of the thickness may be made 4.0 mm or 3.2 mm while the lower limit may be made 0.8 mm or 1.0 mm. The tensile strength of the steel member may be made over 1500 MPa, but if necessary many also be made 1700 MPa or more, 1800 MPa or more, or 1900 MPa or more. The upper limit of the tensile strength does not particularly have to be prescribed, but may be 2500 MPa or less or 2300 MPa or less.

(B) Steel Sheet

Next, the steel sheet will be explained.

(B1) Chemical Composition of Steel Sheet

The chemical composition of the steel sheet is the same as the chemical composition of the steel member explained above. The reasons for limitation are also similar.

(B2) Structure of Steel Sheet

The steel sheet according to the present embodiment has a metallic structure with a maximum value of the content of Cu in a range of a depth of 0 to 30 μm from the surface of 1.2 times or more the content of Cu at a position of a depth from the surface of 200 μm and with an average crystal grain size of 30 μm or less.

Degree of Surface Concentration of Cu: 1.2 or More

The Cu concentrated at the surface of the steel sheet has the effect of further concentrating at the surface in the later explained heat treatment and forming a dense rust layer at the time of use of the member to thereby suppress pitting and improve the hydrogen embrittlement resistance in a corrosive environment. If the degree of surface concentration of Cu of the steel sheet is less than 1.2, the degree of surface concentration of Cu of the steel member becomes less than 1.4 and the risk of hydrogen embrittlement rises along with corrosion. Therefore, the degree of surface concentration of Cu of the steel sheet is made 1.2 or more. Preferably, it is 1.4 or more. The upper limit of the degree of surface concentration of Cu does not particularly have to be prescribed, but may be made 2.5 or 2.1.

Average Crystal Grain Size: 30 μm or Less

The crystal grain boundaries function as paths for diffusion, so refinement of the crystal grain size results in the number of diffusion paths per unit volume increasing and as a result the actual diffusion rate becoming large, so there is the effect of further promoting the concentration of Cu at the surface in the later explained heat treatment. Therefore, refining the crystal grain size is necessary. If the average crystal grain size of the steel sheet is over 30 μm, the degree of surface concentration of Cu of the steel member becomes less than 1.4 and the risk of hydrogen embrittlement rises along with corrosion. Therefore, the average crystal grain size of the steel sheet is made 30 μm or less. Preferably, it is 25 μm or less. The lower limit does not particularly have to be prescribed, but may be made 8 μm or 15 μm.

The average crystal grain size of the steel sheet is found as follows based on JIS G 0551: 2013.

A cross-section of a width (¼) part is cut out from an end of the steel sheet in the width direction so that it is parallel to the rolling direction and parallel to the thickness direction. The cross-section is polished to a mirror finish, then treated by a Nital corrosive solution to reveal the crystal grain boundaries of the ferrite. On a field enlarged using an optical microscope or a photograph taken by the same, three test lines are drawn at equal intervals in the vertical direction and three in the horizontal direction and the average line segment length per crystal grain is found. Note that, the magnification of the microscope is selected so that at least 10 or more crystal grains are caught by one test line and five random fields are examined from positions of ¼ or so of the thickness away from the surface of the steel sheet. Here, based on Appendix C.2.1 of JIS G 0551: 2013, if a test line passes through a crystal grain, the number of crystal grains caught is made 1 for that crystal, while if a test line ends inside a crystal grain or if a test line is contiguous with a crystal grain, the number of crystal grains caught is made is made 0.5. The average line segment length in each field is found and the average of the average line segment lengths of five fields for each of three test lines (total 15 average line segment lengths) is made the average crystal grain size.

Further, the structure present in the present embodiment is comprised of ferrite or pearlite. In the conditions of the method of manufacture explained later, bainite, martensite, and residual austenite are sometimes included. Note that, the above-mentioned martensite includes tempered and auto-tempered martensite. Auto-tempered martensite is tempered martensite formed during the cooling at the time of hardening without performing heat treatment for tempering and is formed by the martensite formed being tempered on the spot by the heat generated along with martensite transformation.

The thickness of the steel sheet does not particularly have to be prescribed, but may be made 0.5 to 5.0 mm. The upper limit of the thickness may be made 4.0 mm or 3.2 mm while the lower limit may be made 0.8 mm or 1.0 mm.

Next, the method for manufacturing the steel sheet will be explained.

(C) Method for Manufacturing Steel Sheet

Steel sheet before heat treatment for obtaining the steel member according to the present embodiment can be manufactured by using the method of manufacture shown below.

Steel having the above-mentioned chemical composition is melted in a furnace and cast, then the obtained slab is heated to 1100 to 1350° C. and hot rolled. In the hot rolling process, it is rough rolled, then descaled according to need and finally is finish rolled.

At this time, the following parameter Si comprised of the time t1 (hr) from the end of rough rolling to the start of finish rolling and the average temperature T1 (° C.) of the rough bar during that is made 20000 or more. Here, if performing descaling after rough rolling, "the time from the end of rough rolling to the start of finish rolling" means the time until the start of finish rolling after the end of descaling.

$$S1=(T1+273)\times(\log t1+20)$$

Further, the finish rolling ends at the $Ar_3$ point to 1000° C. After that, the steel sheet is cooled by an average cooling rate of 10° C./s or more and coiled at 700° C. or less. The features of the hot rolling process will be explained below:

Slab heating temperature: 1100 to 1350° C.

The slab heating temperature before starting the hot rolling is made 1100 to 1350° C. If this temperature is over 1350° C., the austenite grain size becomes larger during the heating and sometimes the average crystal grain size of the steel sheet obtained after rolling exceeds 30 μm. On the other hand, if this temperature is 1100° C. or less, the alloying elements do not become sufficiently uniform and sometimes the toughness and hydrogen embrittlement resistance deteriorate after the later explained heat treatment.

S1 from End of Rough Rolling to Start of Finish Rolling: 20000 or More

Cu is an element which is difficult to oxidize, so elements other than Cu are preferentially oxidized in the hot rolling process whereby the Cu concentrates at the surface. In particular, if making the parameter S1 comprised of the time t1 (hr) from the end of rough rolling to the start of finish rolling and the average temperature T1 (° C.) of the rough bar during that 20000 or more from the end of rough rolling to the start of finish rolling, it becomes possible to make the Cu concentrate 1.2 times or more at the surface of the steel sheet. If the parameter S1 is less than 20000, the steel sheet insufficiently oxidizes and sometimes the degree of surface concentration of Cu becomes less than 1.2. The upper limit of the above parameter S1 is not particularly prescribed, but if over 30000, sometimes a tremendous amount of scale forms due to the oxidation and the yield falls.

Finish rolling end temperature: $Ar_3$ point to 1000° C.

The end temperature of the finish rolling is made the $Ar_3$ point to 1000° C. If the finish rolling end temperature is over 1000° C., recrystallization of austenite occurs right after rolling and the number of nucleation sites of ferrite is limited, so the average grain size of the steel sheet obtained by rolling sometimes exceeds 30 μm. On the other hand, if the finish temperature is less than the $Ar_3$ point, the rolling is performed after ferrite transformation and abnormal grain growth of the ferrite is invited, so the average crystal grain size of the steel sheet obtained after rolling sometimes exceeds 30 μm.

Average Cooling Rate from Completion of Finish Rolling to Coiling: 10° C./s or More The average cooling rate from completion of finish rolling to coiling is made 10° C./s or more. If this average cooling rate is less than 10° C./s, the ferrite grains proceed to grow and sometimes the average crystal grain growth after rolling exceeds 30 μm. The upper limit of this cooling rate is not particularly prescribed, but if over 150° C./s, the steel sheet is coiled without the ferrite transformation being completed. The transformation proceeds even after coiling, so sometimes the coil deforms due to the transformation strain.

Coiling Temperature: 700° C. or Less

The coiling temperature is made 700° C. or less. If this temperature is over 700° C., the ferrite grains proceed to grow and sometimes the average crystal grain size of the steel sheet after rolling exceeds 30 μm. The lower limit of this temperature is not particularly prescribed, but if falling below 500° C., martensite or bainite transformation occurs after coiling, so sometimes the coil deforms due to the transformation strain.

The hot rolled steel sheet is descaled. The descaling is made lighter pickling compared with the pickling of usual steel sheet which removes only the iron scale by hydrochloric acid or sulfuric acid pickling. Specifically, when using hydrochloric acid or sulfuric acid, making the pickling temperature 80 to 90° C., designating the acid concentration as a (%), and designating the pickling time as "t" (s), preferably $6\leq\alpha<14$, $0<t\leq20-30\times\alpha$.

FIG. 1 shows the preferable pickling conditions (relationship of acid concentration and pickling time). For example, it is possible to use concentration 12% hydrochloric acid for descaling for an immersion time of 30 s to remove only the iron scale and leave the Cu concentrated layer of the surface of the steel sheet obtained in the above hot rolling process.

The steel sheet in the present embodiment may be, in addition to the above-mentioned hot rolled steel sheet (steel sheet obtained by hot rolling), hot rolled annealed steel sheet obtained by annealing the steel sheet, cold rolled steel sheet (steel sheet obtained by cold rolling) obtained by cold rolling the same, or cold rolled annealed steel sheet obtained by cold rolling, then annealing the same. Further, it may be plated steel sheet or other surface treated steel sheet. The treatment processes after the coiling process may be suitably selected in accordance with the demanded level of thickness precision of the finished product etc.

The hot rolled steel sheet which has been treated for descaling can be annealed as required to obtain hot rolled annealed steel sheet. Further, the hot rolled steel sheet or hot rolled annealed steel sheet can be cold rolled as required to obtain cold rolled steel sheet. Furthermore, the cold rolled steel sheet can be annealed as required to obtain cold rolled annealed steel sheet and further may be plated or coated at its surface to obtain surface treated steel sheet.

Note that, if the steel sheet used for the cold rolling or surface treatment is hard, it is preferable to anneal it before cold rolling or before surface treatment to raise the workability of the steel sheet.

The cold rolling may be performed using an ordinary method. From the viewpoint of securing good flatness, the rolling reduction in the cold rolling is preferably made 30% or more. On the other hand, to avoid the load from becoming excessively large, the rolling reduction in the cold rolling is preferably made 80% or less.

If manufacturing hot rolled annealed steel sheet, cold rolled annealed steel sheet, or surface treated steel sheet as the steel sheet of the present embodiment, the hot rolled steel sheet or cold rolled steel sheet is annealed. In the annealing, for example, the hot rolled steel sheet or cold rolled steel sheet is annealed in the 550 to 950° C. temperature region.

By making the heating temperature in the annealing 550° C. or more, if manufacturing either hot rolled annealed steel sheet or cold rolled annealed steel sheet, the difference in properties accompanying the differences in the hot rolling conditions is reduced and the properties after hardening can be made further stabler. Further, if annealing the cold rolled steel sheet at 550° C. or more, recrystallization causes the cold rolled steel sheet to soften, so the workability can be raised. That is, it is possible to obtain cold rolled annealed steel sheet provided with excellent workability. Therefore, the heating temperature in the annealing is preferably made 550° C. or more.

On the other hand, if the heating temperature in the annealing is over 950° C., sometimes the structure becomes coarser. Coarsening of the structure sometimes causes the toughness after hardening to fall. Further, even if the heating temperature in the annealing is over 950° C., the effect due to just raising the temperature cannot be obtained, the costs rise, and the productivity merely falls. Therefore, the heating temperature in the annealing is preferably made 950° C. or less.

After annealing, preferably the steel sheet is cooled by a 3 to 30° C./s average cooling rate down to 550° C. By making the average cooling rate 3° C./s or more, formation of coarse pearlite and coarse cementite can be suppressed and the properties after hardening can be improved. Further, by making the above average cooling rate 30° C./s or less, it becomes easy to suppress the occurrence of uneven strength etc. and make the quality of the hot rolled annealed steel sheet or cold rolled annealed steel sheet stabler.

In the case of surface treated steel sheet, the plated or coated layer at the surface may be an electroplated layer or may be a hot dip coated layer or alloyed hot dip coated layer. As the electroplated layer, an electrogalvanized layer, electro-Zn—Ni alloy plated layer, etc. may be illustrated. As the hot dip coated layer, a hot dip aluminum coated layer, hot dip Al—Si coated layer, hot dip Al—Si—Mg coated layer, hot dip galvanized layer, hot dip Zn—Mg coated layer, etc. may be illustrated. As the alloyed hot dip coated layer, an alloyed hot dip aluminum coated layer, alloyed hot dip Al—Si coated layer, alloyed hot dip Al—Si—Mg coated layer, alloyed hot dip galvanized layer, alloyed hot dip Zn—Mg coated layer, etc. may be illustrated. The plated layer etc. may also contain Mn, Cr, Cu, Mo, Ni, Sb, Sn, Ti, Ca, Sr, Mg, etc. The amount of deposition of the plated layer etc. is not particularly limited. For example, it is made within a general range of amount of deposition. In the same way as steel sheet, the steel member after heat treatment may be provided with a plated layer etc. or alloyed plated layer etc.

(D) Method for Manufacturing Steel Member

Next, the method for manufacturing the steel member according to the present embodiment will be explained.

In the method for manufacturing the steel member of the present embodiment, by taking steel sheet having the above-mentioned chemical composition and having a structure with a maximum value of the content of Cu in a range of a depth of 0 to 30 μm from the surface of 1.2 times or more the content of Cu at a depth of 200 μm from the surface and with an average crystal grain size of 30 μm or less and subjecting it to the heat treatment shown below, it is possible to obtain a steel member excellent in hydrogen embrittlement resistance in a corrosive environment where the maximum value of the content of Cu in a range of a depth of 0 to 30 μm from the surface is 1.4 times or more the content of Cu at a depth of 200 μm from the surface.

The average rate of temperature rise explained below is made the value of the amount of temperature rise of the steel sheet from the time of start of heating to the time of end of heating divided by the time required from the time of start of heating to the time of end of heating.

Further, the average cooling rate is made the value of the amount of temperature fall from the time of start of cooling to the time of end of cooling divided by the time required from the time of start of cooling to the time of end of cooling.

The above-mentioned steel sheet is heated by a 5 to 1000° C./s average rate of temperature rise up to T2 (° C.) of the temperature region of the $Ac_3$ point to ($Ac_3$ point+300°) C., is cooled down to Ms ° C. by an average cooling rate made the upper critical cooling rate or more, then cooled from the Ms point to 100° C. or less by an average cooling rate of 5° C./s or more. At the time of heating, the following parameter, comprised of the peak heating temperature T2 (° C.) and the time t2 (hr) from when reaching a temperature 10° C. lower than T2 to when ending the heating, is made 19000 or more. The features of this heat treatment will be explained below. Here, the upper critical cooling rate is the minimum cooling rate where the structure becomes 100% martensite. Various methods are known as the method for measuring this, but one example will be explained in the section on examples. Further, the time until ending the heating means the time until right before starting cooling. For example, if held for a certain time after reaching T2 (° C.), that holding time is also included.

$$S2=(T2+273-10)\times(\log t2+20)$$

S2 from Peak Heating Temperature −10° C. to Heating End: 19000 or More

Cu is an element concentrating at the surface at the time of heating, so if making the above parameter S2 comprised of the peak heating temperature T2 (° C.) and the time t2 (hr) from when reaching a temperature 10° C. lower than T2 to when ending the heating 19000 or more, the Cu can be made to concentrate at the surface of the steel sheet using the grain boundaries as main paths for diffusion and the Cu can be made to concentrate at the surface 1.4 times or more. If the above parameter S2 is less than 19000, sometimes the Cu insufficiently diffuses and the degree of surface concentration of Cu becomes less than 1.4. The upper limit of S2 is not particularly prescribed, but if over 30000, sometimes an enormous amount of scale is formed by oxidation and the yield falls.

Note that if the rate of temperature rise is less than 5° C./s, the structure becomes coarser and the toughness or hydrogen embrittlement resistance falls, so this is not preferable. On the other hand, if the rate of temperature rise is over 1000° C./s, the structure becomes a mixed grain type and the toughness or hydrogen embrittlement resistance falls, so this is not preferable.

Further, if the heating temperature is less than the Ac3 point, a small amount of ferrite remains mixed in after the cooling and the toughness or hydrogen embrittlement resistance and strength fall, so this is not preferable. On the other hand, if the peak temperature of heating is over the ($Ac_3$ point+300), the structure becomes coarser and the toughness falls, so this is not preferable.

Further, if the average cooling rate from the Ms point to 100° C. or less is less than 5° C./s, the spot tempering of the martensite (auto-tempering) excessively proceeds and the strength becomes insufficient, so this is not preferable.

Here, at the time of the above series of heat treatment, it is also possible to perform hot shaping such as hot stamping while cooling to the Ms point after heating to a temperature region of the $Ac_3$ point to ($Ac_3$ point+300°) C., that is, simultaneously with the process of cooling by the upper critical cooling rate or more. As the hot shaping, bending, drawing, bulging, hole expanding, flanging, etc. may be mentioned. Further, if providing means for cooling the steel sheet simultaneously with or directly after shaping, the present invention may also be applied to a shaping method other than press forming, for example, roll forming. Note that if following the above-mentioned heat history, it is also possible to repeatedly perform hot shaping.

Note that, as explained above, in the present invention, both what is hot shaped to form a shaped article and what is only heat treated to form a flat sheet will be referred to together as "steel members".

Further, it is possible to hot shape or heat treat part of the steel materials to obtain steel members having regions of different strengths.

The above series of heat treatment can be performed by any methods. For example, they may be performed by high frequency hardening, ohmic heating, or furnace heating.

EXAMPLES

Below, examples will be used to more specifically explain the present invention, but the present invention is not limited to these examples.

First, in manufacturing the steel sheet and steel member, steel having each of the chemical compositions of Tables 1-1 to 1-2 was melted to obtain a slab for hot rolling use.

TABLE 1

Table 1-1

| | Steel no. | Chemical composition(mass %) C | Si | Mn | P | S | N | Ti | B | Cu | Mo | Cr | Ni |
|---|---|---|---|---|---|---|---|---|---|---|---|---|---|
| Inv. ex. | A1 | 0.29 | 0.40 | 0.90 | 0.010 | 0.0007 | 0.004 | 0.040 | 0.0025 | 0.21 | 0.19 | | |
| | A2 | 0.50 | 0.50 | 0.40 | 0.012 | 0.0005 | 0.003 | 0.032 | 0.0026 | 0.25 | 0.15 | 0.10 | 0.10 |
| | A3 | 0.30 | 0.30 | 1.00 | 0.011 | 0.0008 | 0.004 | 0.040 | 0.0025 | 0.20 | 0.18 | | |
| | A4 | 0.32 | 1.60 | 0.90 | 0.012 | 0.0006 | 0.002 | 0.032 | 0.0026 | 0.26 | 0.16 | 0.20 | |
| | A5 | 0.31 | 0.35 | 0.32 | 0.009 | 0.0010 | 0.002 | 0.040 | 0.0025 | 0.21 | 0.20 | | 0.15 |
| | A6 | 0.34 | 0.40 | 2.50 | 0.018 | 0.0010 | 0.002 | 0.032 | 0.0026 | 0.26 | 0.15 | | |
| | A7 | 0.36 | 0.55 | 0.95 | 0.030 | 0.0009 | 0.002 | 0.040 | 0.0025 | 0.20 | 0.20 | | |
| | A8 | 0.38 | 0.60 | 0.80 | 0.010 | 0.0080 | 0.002 | 0.040 | 0.0025 | 0.21 | 0.21 | | |
| | A9 | 0.33 | 0.70 | 0.75 | 0.009 | 0.0012 | 0.008 | 0.032 | 0.0026 | 0.21 | 0.20 | 0.23 | |
| | A10 | 0.30 | 0.55 | 0.70 | 0.008 | 0.0010 | 0.003 | 0.020 | 0.0025 | 0.24 | 0.15 | | |
| | A11 | 0.36 | 0.63 | 0.65 | 0.012 | 0.0009 | 0.002 | 0.080 | 0.0026 | 0.25 | 0.20 | 0.15 | |
| | A12 | 0.34 | 0.38 | 0.85 | 0.014 | 0.0009 | 0.002 | 0.034 | 0.0010 | 0.21 | 0.18 | | 0.18 |
| | A13 | 0.34 | 0.41 | 0.75 | 0.016 | 0.0008 | 0.003 | 0.022 | 0.0060 | 0.27 | 0.20 | | |
| | A14 | 0.36 | 0.40 | 0.77 | 0.010 | 0.0010 | 0.004 | 0.040 | 0.0025 | 0.18 | 0.16 | | |
| | A15 | 0.37 | 0.45 | 0.80 | 0.008 | 0.0009 | 0.003 | 0.032 | 0.0026 | 0.70 | 0.21 | | 0.23 |
| | A16 | 0.36 | 0.52 | 0.78 | 0.010 | 0.0008 | 0.004 | 0.040 | 0.0025 | 0.20 | 0.13 | | 0.10 |
| | A17 | 0.39 | 0.50 | 0.69 | 0.009 | 0.0006 | 0.002 | 0.032 | 0.0026 | 0.28 | 0.70 | | |
| | A18 | 0.33 | 0.39 | 0.65 | 0.012 | 0.0008 | 0.004 | 0.040 | 0.0025 | 0.21 | 0.20 | 0.70 | |
| | A19 | 0.31 | 0.40 | 0.55 | 0.008 | 0.0005 | 0.003 | 0.032 | 0.0026 | 0.25 | 0.15 | | 0.60 |
| | A20 | 0.30 | 0.42 | 0.67 | 0.007 | 0.0007 | 0.006 | 0.040 | 0.0025 | 0.20 | 0.20 | 0.10 | |
| | A21 | 0.35 | 0.51 | 0.78 | 0.008 | 0.0006 | 0.003 | 0.032 | 0.0026 | 0.24 | 0.15 | | 0.23 |
| | A22 | 0.36 | 0.35 | 0.90 | 0.005 | 0.0008 | 0.005 | 0.040 | 0.0025 | 0.20 | 0.20 | | |
| | A23 | 0.40 | 0.63 | 0.75 | 0.010 | 0.0008 | 0.004 | 0.040 | 0.0025 | 0.20 | 0.20 | 0.14 | |
| | A24 | 0.32 | 0.43 | 0.65 | 0.009 | 0.0005 | 0.003 | 0.032 | 0.0026 | 0.21 | 0.16 | | 0.20 |
| | A25 | 0.31 | 0.47 | 0.60 | 0.010 | 0.0008 | 0.005 | 0.040 | 0.0025 | 0.24 | 0.19 | | |
| | A26 | 0.32 | 0.46 | 1.05 | 0.015 | 0.0005 | 0.003 | 0.032 | 0.0026 | 0.20 | 0.17 | 0.23 | |
| | A27 | 0.36 | 0.52 | 0.90 | 0.016 | 0.0009 | 0.003 | 0.026 | 0.0026 | 0.24 | 0.19 | | 0.15 |
| | A28 | 0.30 | 0.40 | 0.90 | 0.010 | 0.0008 | 0.004 | 0.040 | 0.0025 | 0.20 | 0.20 | | |
| | A29 | 0.35 | 0.50 | 0.75 | 0.008 | 0.0005 | 0.003 | 0.032 | 0.0026 | 0.25 | 0.15 | 0.10 | 0.15 |

| | Steel no. | Chemical composition(mass %) V | Ca | Al | Nb | Sn | W | Sb | REMs | Transformation point (° C.) Ar3 | Ac3 | Ms | Upper critical cooling rate (° C./s) |
|---|---|---|---|---|---|---|---|---|---|---|---|---|---|
| Inv. ex. | A1 | | | | | | | | | 793 | 826 | 396 | 20 |
| | A2 | | | 0.04 | 0.04 | | | | | 774 | 808 | 326 | 20 |
| | A3 | | | | | | | | | 781 | 815 | 388 | 20 |
| | A4 | | | | | 0.10 | | | | 860 | 895 | 370 | 10 |
| | A5 | | | | 0.01 | | | | 0.20 | 801 | 831 | 409 | 40 |
| | A6 | 0.25 | 0.004 | | | | | | | 744 | 775 | 312 | 10 |
| | A7 | | | | 0.02 | | 0.18 | | | 809 | 834 | 361 | 20 |
| | A8 | | | 0.06 | | | | 0.15 | | 805 | 834 | 361 | 20 |
| | A9 | 0.30 | | | | | | | | 804 | 836 | 377 | 20 |
| | A10 | | | | | | 0.15 | | 0.15 | 793 | 829 | 396 | 30 |
| | A11 | | 0.003 | | | | | | | 816 | 849 | 368 | 20 |
| | A12 | | | | | | | | | 779 | 812 | 377 | 20 |
| | A13 | | | | 0.03 | 0.24 | | | | 785 | 818 | 378 | 20 |
| | A14 | 0.25 | | | | | 0.30 | | | 787 | 815 | 371 | 20 |
| | A15 | | | | 0.03 | | | 0.26 | | 768 | 795 | 356 | 20 |
| | A16 | | | | | 0.26 | | | | 793 | 819 | 372 | 20 |
| | A17 | | 0.003 | | | | | | 0.18 | 799 | 832 | 349 | 10 |
| | A18 | | | 0.05 | | | 0.25 | | | 789 | 826 | 372 | 10 |
| | A19 | | 0.002 | | | | | 0.15 | | 781 | 818 | 396 | 30 |
| | A20 | 0.70 | | | 0.05 | | 0.20 | | | 798 | 829 | 398 | 30 |
| | A21 | | 0.008 | | | 0.15 | | | | 782 | 815 | 375 | 20 |
| | A22 | 0.10 | | 0.70 | | | | 0.27 | | 852 | 882 | 367 | 20 |

TABLE 1-continued

Table 1-1

| | | | | | | | | | | | | | | |
|---|---|---|---|---|---|---|---|---|---|---|---|---|---|---|
| A23 | | | | | 0.07 | | | | | | 792 | 826 | 350 | 20 |
| A24 | | | | | | 0.60 | | | | 0.15 | 793 | 824 | 390 | 30 |
| A25 | | 0.002 | | | | | 0.70 | | | | 806 | 833 | 397 | 30 |
| A26 | | | | | 0.03 | | | 0.60 | | | 789 | 815 | 373 | 20 |
| A27 | | 0.002 | | | | 0.16 | | | | 0.20 | 783 | 817 | 364 | 20 |
| A28 | | | | | | | 0.16 | | | | 792 | 826 | 389 | 20 |
| A29 | | | | 0.04 | 0.04 | | | | | | 785 | 817 | 370 | 20 |

TABLE 2

Table 1-2

| | Steel | Chemical composition(mass %) | | | | | | | | | | | |
|---|---|---|---|---|---|---|---|---|---|---|---|---|---|
| | no. | C | Si | Mn | P | S | N | Ti | B | Cu | Mo | Cr | Ni |
| Comp. ex. | a1 | 0.17 | 0.40 | 0.85 | 0.010 | 0.0008 | 0.004 | 0.040 | 0.0025 | 0.08 | 0.18 | 0.10 | 0.10 |
| | a2 | 0.80 | 0.50 | 0.80 | 0.008 | 0.0006 | 0.003 | 0.032 | 0.0026 | 0.10 | 0.16 | | |
| | a3 | 0.33 | 0.02 | 0.30 | 0.011 | 0.0008 | 0.004 | 0.040 | 0.0025 | 0.09 | 0.12 | 0.20 | |
| | a4 | 0.45 | 3.00 | 1.50 | 0.007 | 0.0009 | 0.005 | 0.032 | 0.0026 | 0.11 | 0.25 | 0.40 | 0.25 |
| | a5 | 0.36 | 0.40 | 0.05 | 0.009 | 0.0009 | 0.004 | 0.040 | 0.0025 | 0.10 | 0.15 | | |
| | a6 | 0.40 | 0.45 | 5.00 | 0.018 | 0.0010 | 0.003 | 0.032 | 0.0026 | 0.11 | 0.21 | | |
| | a7 | 0.40 | 0.52 | 0.90 | 0.100 | 0.0009 | 0.002 | 0.040 | 0.0025 | 0.10 | 0.20 | | 0.20 |
| | a8 | 0.43 | 0.47 | 0.80 | 0.010 | 0.1000 | 0.001 | 0.040 | 0.0025 | 0.11 | 0.15 | 0.43 | |
| | a9 | 0.37 | 0.39 | 0.85 | 0.010 | 0.0010 | 0.100 | 0.032 | 0.0026 | 0.08 | 0.20 | | |
| | a10 | 0.44 | 0.40 | 0.79 | 0.000 | 0.0010 | 0.001 | 0.001 | 0.0025 | 0.10 | 0.17 | 0.15 | |
| | a11 | 0.30 | 0.56 | 0.75 | 0.009 | 0.0008 | 0.006 | 0.300 | 0.0026 | 0.08 | 0.21 | | 0.20 |
| | a12 | 0.34 | 0.45 | 0.69 | 0.008 | 0.0010 | 0.004 | 0.021 | 0.0002 | 0.10 | 0.18 | 0.50 | |
| | a13 | 0.40 | 0.52 | 0.74 | 0.010 | 0.0009 | 0.002 | 0.022 | 0.0500 | 0.11 | 0.22 | | |
| | a14 | 0.35 | 0.50 | 0.40 | 0.009 | 0.0008 | 0.004 | 0.021 | 0.0025 | 0.05 | 0.15 | | 0.20 |
| | a15 | 0.37 | 0.45 | 0.45 | 0.010 | 0.0009 | 0.004 | 0.025 | 0.0020 | 0.10 | 0.12 | 0.10 | |
| | a16 | 0.41 | 0.39 | 1.10 | 0.012 | 0.0006 | 0.003 | 0.022 | 0.0026 | 3.00 | 0.20 | 0.40 | |
| | a17 | 0.39 | 0.40 | 0.81 | 0.008 | 0.0008 | 0.006 | 0.021 | 0.0025 | 0.12 | 0.02 | | |
| | a18 | 0.39 | 0.66 | 1.00 | 0.007 | 0.0005 | 0.003 | 0.022 | 0.0025 | 0.09 | 3.00 | | 0.25 |
| | a19 | 0.42 | 0.51 | 0.76 | 0.008 | 0.0007 | 0.005 | 0.026 | 0.0026 | 0.10 | 0.20 | 2.00 | |
| | a20 | 0.40 | 0.63 | 0.65 | 0.010 | 0.0008 | 0.002 | 0.031 | 0.0031 | 0.10 | 0.22 | 0.30 | |
| | a21 | 0.44 | 0.88 | 0.60 | 0.010 | 0.0008 | 0.002 | 0.031 | 0.0031 | 0.11 | 0.21 | 0.35 | 0.20 |

| | Steel | Chemical composition(mass %) | | | | | | | | Transformation point (° C.) | | | Upper critical cooling rate |
|---|---|---|---|---|---|---|---|---|---|---|---|---|---|
| | no. | V | Ca | Al | Nb | Sn | W | Sb | REMs | Ar3 | Ac3 | Ms | (° C./s) |
| Comp. ex. | a1 | | 0.002 | 0.04 | 0.04 | | | 0.30 | 0.40 | 817 | 847 | 432 | 30 |
| | a2 | | | | | | | | | 728 | 756 | 190 | 10 |
| | a3 | | | | | 0.25 | | | | 769 | 801 | 401 | 60 |
| | a4 | | | | 0.01 | | | | 0.20 | 894 | 916 | 272 | 10 |
| | a5 | 0.25 | 0.004 | | | | | | | 803 | 830 | 396 | 70 |
| | a6 | | | | 0.08 | | 0.18 | | | 682 | 710 | 191 | 10 |
| | a7 | | | 0.06 | | | | 0.15 | | 844 | 879 | 347 | 20 |
| | a8 | 0.30 | | | | | | | | 773 | 805 | 332 | 20 |
| | a9 | | | | | | 0.30 | | 3.00 | 781 | 809 | 361 | 20 |
| | a10 | | 0.003 | 0.06 | | | | | | 748 | 780 | 333 | 20 |
| | a11 | | | | | | | | | 893 | 914 | 390 | 20 |
| | a12 | | | | 0.03 | 0.24 | | | | 773 | 809 | 369 | 70 |
| | a13 | 0.25 | | | | | 0.30 | | 0.45 | 783 | 811 | 354 | 20 |
| | a14 | | | 0.05 | 0.03 | | | 0.36 | | 793 | 825 | 390 | 40 |
| | a15 | | | 0.05 | 0.05 | 0.10 | | | | 790 | 822 | 380 | 30 |
| | a16 | | | | | 0.30 | | | | 699 | 736 | 275 | 10 |
| | a17 | 0.45 | 0.004 | | | | 0.40 | | 0.23 | 768 | 798 | 359 | 40 |
| | a18 | | | | 0.04 | | | 0.40 | | 860 | 892 | 284 | 10 |
| | a19 | 0.30 | | 0.08 | | 0.40 | | | | 762 | 797 | 302 | 10 |
| | a20 | 0.50 | | | | 2.00 | | | | 787 | 822 | 350 | 20 |
| | a21 | | | 0.08 | | — | | 2.00 | | 806 | 836 | 333 | 10 |

$Ar_3$ Point, $Ac_3$ Point, Ms Point, and Upper Critical Cooling Rate

Each obtained slab was examined to find the $Ar_3$ point, $Ac_3$ point, Ms point, and upper critical cooling rate by the following methods. The results are shown in Tables 1-1 to 1-2.

From the slab, a diameter 3 mm, length 10 mm columnar test piece was cut out. The test piece was heated in an air atmosphere up to 1000° C. by a 10° C./s average rate of temperature rise, was held at that temperature for 5 minutes, then was cooled by various cooling rates down to room temperature. The cooling rates were set to 1° C./s to 100° C./s at 10° C./s intervals. The change in thermal expansion of the test piece during the heating and cooling at that time was measured and the structure of the test piece after cooling was examined to measure the $Ar_3$ point, $Ac_3$ point, Ms point, and upper critical cooling rate.

The upper critical cooling rate was made the minimum cooling rate at which no precipitation of ferrite phases occurred in test pieces cooled by the above cooling rates.

Next, the obtained slab was used to prepare steel members and steel sheets shown in the following Examples 1 to 4.

Example 1

Each slab of the above Tables 1-1 to 1-2 was hot rolled to obtain a thickness 3.0 mm hot rolled steel sheet. In the hot rolling process, the slab heating temperature was made 1250° C., the parameter Si from the end of rough rolling to the start of finish rolling was made 22657, the finish rolling end temperature was made 930° C., and the steel sheet was cooled by an average cooling rate of 20° C./s until coiling and coiled at 550° C.

The parameter S1 was controlled to 22657 in the range of a time from the end of rough rolling to the start of finish rolling of 1 to 60 seconds and an average temperature of the rough bar from the end of rough rolling to the start of finish rolling of 950 to 1150° C. After that, the above hot rolled steel sheet was descaled by concentration 12%, temperature 90° C. hydrochloric acid for 30 seconds. After that, the cold rolling machine was used for cold rolling to obtain thickness 1.4 mm cold rolled steel sheet.

The above cold rolled steel sheet was heated up to 920° C. by an average rate of temperature rise of 10° C./s, the parameter S2 comprised of the peak temperature and holding time was made 21765, and the steel sheet was cooled down to the Ms point by an average cooling rate of 50° C./s, then cooled down to 100° C. by an average cooling rate of 30° C./s as heat treatment to obtain the steel member. Note that the above parameter S2 was controlled to 21581 in the range of the peak temperature $Ac_3$ point of the steel sheet to the $Ac_3$ point+300° C. for a time of 1 to 600 seconds from when reaching a temperature of 10° C. lower than the peak temperature until the end of heating.

After that, the obtained steel member was cut out and subjected to GDS (glow discharge optical emission spectrometry), a tensile test, and Charpy impact test, CCT (salt spray cyclic corrosion test), and thiocyanic acid immersion test by the following methods to evaluate the degree of surface concentration of Cu, tensile strength, impact value, critical number of cycles of CCT (hydrogen embrittlement resistance in a corrosive environment), and critical amount of hydrogen. The results of evaluation are shown in Table 2.

Degree of Surface Concentration of Cu

The degree of surface concentration of Cu was measured by the following procedure.

GDS (glow discharge optical emission spectrometry) was performed in the thickness direction from the surface of the steel member to detect the content of Cu. At this time, the value of the maximum value of the content of Cu in a range of a depth of 0 to 30 μm from the surface divided by the content of Cu at a depth of 200 μm from the surface was calculated to find the degree of surface concentration of Cu. The measurement by GDS was performed at five random points in parallel with the rolling direction at ¼ of the sheet width from an end of the steel member in the width direction. The average was made the degree of surface concentration of Cu. Note that, here, the "surface" was made the depth where Fe became 80% or more when performing GDS from the surface of the steel member.

Tensile Strength

A tensile test was conducted based on the provisions of the ASTM Standard E8. A soaking part of the steel member was ground down to a thickness of 1.2 mm, then a half size plate-shaped test piece (parallel part length: 32 mm, parallel part width: 6.25 mm) of ASTM standard E8 was taken so that the test direction became parallel to the rolling direction.

Further, a strain gauge (gauge length: 5 mm) was attached to each test piece and a room temperature tensile test was conducted by a strain rate of 3 mm/min to measure the tensile strength (maximum strength). In the present embodiment, cases having a tensile strength over 1500 MPa were evaluated as being excellent in strength.

Impact Value

A Charpy impact test was conducted based on the provisions of JIS Z 2242: 2018. The soaked part of the steel member was ground down to a thickness of 1.2 mm, test pieces were cut out in parallel to the rolling direction, and three of these were stacked to prepare a V-notch test piece. The Charpy impact test was performed at the test temperature −40° C. to find the impact value (absorption energy). In the present embodiment, the obtained absorption energy was divided by the three pieces' worth of cross-sectional area below the notch. Cases having a 30 $J/cm^2$ or more impact value were evaluated as being excellent in toughness.

Critical Number of Cycles of CCT

The CCT was performed based on the provisions of the neutral salt spray cycle test method described in JIS H 8502: 1999. The surface scale of the soaked part of the steel member was removed by shot blasting and a width 8 mm, length 68 mm strip shaped test piece was prepared. Further, a strain gauge (gauge length: 5 mm) similar to the tensile test was attached to the center of the test piece surface in the width and length directions and was bent by a four-point support jig until a strain equivalent to ½ of the tensile strength. The test piece bent at four points was inserted in the CCT apparatus together with its jig and subjected to the CCT described in the above comprised of cycles of spraying saltwater for 2 hours, drying for 4 hours, and wetting for 2 hours. During this, the test piece was observed for 3 cycles every 24 hours and was checked for any cracking up to 360 cycles. The critical number of cycles up to which no cracking occurred was found. In the present embodiment, the test was conducted five times and cases where no hydrogen embrittlement cracking occurred up to an average 150 cycles were deemed excellent in hydrogen embrittlement resistance in a corrosive environment.

Critical Amount of Hydrogen

Thiocyanic acid immersion was performed by immersing a test piece bent supported at four points by the above method together with a jig in an ammonium thiocyanate aqueous solution. The ammonium thiocyanate aqueous solution was prepared by mixing an ammonium thiocyanate reagent into 2 liters of distilled water. 72 hours after the start of dipping, the test piece was taken out and examined for any cracks. Simultaneously, it was analyzed for amount of hydrogen by the temperature desorption method up to 300° C. The concentration of the ammonium thiocyanate aqueous solution was changed to change the amount of hydrogen charged to conduct the test. The largest amount of hydrogen where no cracks occurred was deemed the critical amount of hydrogen. In the present embodiment, the test was performed five times and a case having a critical amount of hydrogen of an average 0.25 mass ppm or more was deemed excellent in hydrogen embrittlement resistance.

As shown in Table 2, Invention Examples B1 to B29 satisfying the scope of the present invention turned out to be good in both structure and properties, but Comparative Examples b1 to b21 not satisfying the scope of the present invention turned out to not satisfy at least one of the structure and properties.

TABLE 3

Table 2

| | | | Steel member | | | | |
|---|---|---|---|---|---|---|---|
| | No. | Steel no. | Cu surface concentration | Tensile strength (MPa) | Impact value −40° C. (J/cm$^2$) | CCT No. of cycles | Critical hydrogen amount (ppm) |
| Inv. ex. | B1 | A1 | 1.5 | 1897 | 61 | 360 | 0.49 |
| | B2 | A2 | 1.6 | 2742 | 35 | 183 | 0.27 |
| | B3 | A3 | 1.5 | 1947 | 60 | 360 | 0.50 |
| | B4 | A4 | 1.6 | 2046 | 45 | 291 | 0.47 |
| | B5 | A5 | 1.5 | 1912 | 60 | 360 | 0.49 |
| | B6 | A6 | 1.7 | 2273 | 42 | 192 | 0.33 |
| | B7 | A7 | 1.5 | 2199 | 43 | 204 | 0.33 |
| | B8 | A8 | 1.5 | 2271 | 48 | 210 | 0.36 |
| | B9 | A9 | 1.5 | 2056 | 53 | 303 | 0.40 |
| | B10 | A10 | 1.6 | 1915 | 56 | 324 | 0.49 |
| | B11 | A11 | 1.7 | 2072 | 54 | 360 | 0.45 |
| | B12 | A12 | 1.5 | 2103 | 52 | 303 | 0.38 |
| | B13 | A13 | 1.6 | 2092 | 53 | 309 | 0.39 |
| | B14 | A14 | 1.4 | 2177 | 50 | 252 | 0.41 |
| | B15 | A15 | 2.3 | 2223 | 43 | 264 | 0.35 |
| | B16 | A16 | 1.6 | 2185 | 44 | 303 | 0.35 |
| | B17 | A17 | 1.8 | 2304 | 41 | 321 | 0.38 |
| | B18 | A18 | 1.6 | 2038 | 52 | 294 | 0.45 |
| | B19 | A19 | 1.7 | 1940 | 52 | 303 | 0.40 |
| | B20 | A20 | 1.5 | 1909 | 66 | 360 | 0.49 |
| | B21 | A21 | 1.6 | 2141 | 55 | 360 | 0.42 |
| | B22 | A22 | 1.5 | 2194 | 55 | 333 | 0.42 |
| | B23 | A23 | 1.5 | 2351 | 48 | 351 | 0.38 |
| | B24 | A24 | 1.6 | 1998 | 52 | 330 | 0.47 |
| | B25 | A25 | 1.7 | 1950 | 62 | 360 | 0.52 |
| | B26 | A26 | 1.6 | 2042 | 54 | 339 | 0.46 |
| | B27 | A27 | 1.8 | 2194 | 52 | 360 | 0.39 |
| | B28 | A28 | 1.5 | 1937 | 61 | 360 | 0.50 |
| | B29 | A29 | 1.6 | 2136 | 55 | 360 | 0.41 |
| Comp. ex. | b1 | a1 | 0.8 | 1400 | 82 | 180 | 0.82 |
| | b2 | a2 | 1.0 | 3069 | 16 | 12 | 0.18 |
| | b3 | a3 | 0.8 | 1490 | 78 | 171 | 0.88 |
| | b4 | a4 | 1.0 | 2700 | 22 | 45 | 0.30 |
| | b5 | a5 | 0.9 | 1425 | 75 | 174 | 0.85 |
| | b6 | a6 | 1.2 | 2801 | 18 | 21 | 0.20 |
| | b7 | a7 | 1.1 | 2369 | 26 | 51 | 0.23 |
| | b8 | a8 | 1.1 | 2483 | 24 | 36 | 0.22 |
| | b9 | a9 | 0.8 | 2230 | 29 | 102 | 0.28 |
| | b10 | a10 | 1.0 | 2523 | 23 | 72 | 0.26 |
| | b11 | a11 | 0.8 | 1422 | 78 | 174 | 0.81 |
| | b12 | a12 | 0.9 | 1483 | 72 | 168 | 0.82 |
| | b13 | a13 | 1.0 | 2352 | 22 | 54 | 0.22 |
| | b14 | a14 | 0.4 | 2102 | 53 | 51 | 0.48 |
| | b15 | a15 | 1.0 | 2192 | 49 | 48 | 0.45 |
| | b16 | a16 | 8.2 | 2427 | 28 | 42 | 0.21 |
| | b17 | a17 | 1.2 | 2310 | 29 | 54 | 0.20 |
| | b18 | a18 | 0.9 | 2335 | 28 | 99 | 0.34 |
| | b19 | a19 | 1.0 | 2436 | 23 | 90 | 0.33 |
| | b20 | a20 | 1.0 | 2345 | 26 | 96 | 0.35 |
| | b21 | a21 | 1.1 | 2513 | 22 | 87 | 0.31 |

Example 2

Each slab of the above Tables 1-1 to 1-2 was hot rolled to obtain a thickness 3.0 mm hot rolled steel sheet. In the hot rolling process, the slab heating temperature was made 1250° C., the parameter S1 from the end of rough rolling to the start of finish rolling was made 22657, the finish rolling end temperature was made 930° C., and the steel sheet was cooled by 20° C./s until coiling and coiled at 550° C. The parameter Si was controlled to 22657 in the range of a time from the end of rough rolling to the start of finish rolling of 1 to 60 seconds and an average temperature of the rough bar from the end of rough rolling to the start of finish rolling of 950 to 1150° C. After that, the above hot rolled steel sheet was descaled by a concentration 12%, temperature 90° C. hydrochloric acid for 30 seconds. After that, the cold rolling machine was used for cold rolling to obtain thickness 1.4 mm cold rolled steel sheet.

The obtained cold rolled steel sheet was evaluated for the degree of surface concentration of Cu by a method similar to the above steel member. Further, the average crystal grain size was found based on JIS G 0551: 2013. The results of evaluation are shown in Table 3.

TABLE 4

Table 3

| | | | Steel sheet | |
|---|---|---|---|---|
| | No. | Steel no. | Cu surface concentration | Average crystal grain size (μm) |
| Inv. ex. | C1 | A1 | 1.3 | 25 |
| | C2 | A2 | 1.5 | 27 |
| | C3 | A3 | 1.3 | 24 |
| | C4 | A4 | 1.5 | 22 |
| | C5 | A5 | 1.3 | 23 |
| | C6 | A6 | 1.5 | 28 |
| | C7 | A7 | 1.3 | 24 |
| | C8 | A8 | 1.4 | 22 |
| | C9 | A9 | 1.3 | 21 |
| | C10 | A10 | 1.4 | 28 |
| | C11 | A11 | 1.5 | 20 |
| | C12 | A12 | 1.3 | 27 |
| | C13 | A13 | 1.4 | 23 |
| | C14 | A14 | 1.2 | 25 |
| | C15 | A15 | 2.0 | 24 |
| | C16 | A16 | 1.4 | 27 |
| | C17 | A17 | 1.6 | 28 |
| | C18 | A18 | 1.4 | 24 |
| | C19 | A19 | 1.5 | 23 |
| | C20 | A20 | 1.3 | 22 |
| | C21 | A21 | 1.4 | 23 |
| | C22 | A22 | 1.3 | 25 |
| | C23 | A23 | 1.4 | 21 |
| | C24 | A24 | 1.4 | 24 |
| | C25 | A25 | 1.5 | 23 |
| | C26 | A26 | 1.4 | 23 |
| | C27 | A27 | 1.6 | 21 |
| | C28 | A28 | 1.3 | 25 |

TABLE 4-continued

Table 3

| | | | Steel sheet | |
|---|---|---|---|---|
| | No. | Steel no. | Cu surface concentration | Average crystal grain size (μm) |
| | C29 | A29 | 1.4 | 23 |
| Comp. ex. | c1 | a1 | 0.7 | 25 |
| | c2 | a2 | 0.8 | 26 |
| | c3 | a3 | 0.7 | 28 |
| | c4 | a4 | 0.8 | 24 |
| | c5 | a5 | 0.7 | 28 |
| | c6 | a6 | 1.0 | 25 |
| | c7 | a7 | 0.9 | 28 |
| | c8 | a8 | 0.9 | 30 |
| | c9 | a9 | 0.7 | 28 |
| | c10 | a10 | 0.8 | 67 |
| | c11 | a11 | 0.7 | 25 |
| | c12 | a12 | 0.8 | 65 |
| | c13 | a13 | 0.9 | 27 |
| | c14 | a14 | 0.3 | 26 |
| | c15 | a15 | 0.8 | 25 |
| | c16 | a17 | 1.0 | 28 |
| | c17 | a18 | 0.8 | 26 |
| | c18 | a19 | 0.8 | 25 |
| | c19 | a20 | 0.8 | 24 |
| | c20 | a21 | 0.9 | 26 |

Invention Examples C1 to C29 satisfying the scope of the present invention turned out to exhibit good degree of surface concentration of Cu and average crystal grain size, but Comparative Examples c1 to c20 not satisfying the scope of the present invention turned out to not satisfy at least one of the degree of surface concentration of Cu and average crystal grain size.

Example 3

Each slab having the steel constituents of each of Steel Nos. A28 and A29 among the steel types shown in Table 1-1 was hot rolled as shown in Tables 4-1 and 4-2 (some heated using bar heater) and pickled (hydrochloric acid or sulfuric acid) to manufacture hot rolled steel sheet (thickness 2.8 mm). The results of evaluation of the structure of the obtained steel sheet are shown in Tables 4-1 and 4-2. Note that, in Tables 4-1 and 4-2, t1 (s) is the time from the end of rough rolling to the start of finish rolling, T1 (° C.) is the average temperature of the rough bar from the end of rough rolling to the start of finish rolling, and Si is a value found by (T1+273)×(logt1+20). However, the unit of t1 in the formula of Si is (hr).

TABLE 5

Table 4-1

| | | | Hot rolling | | | | | | | |
|---|---|---|---|---|---|---|---|---|---|---|
| | No. | Steel no. | Slab heating temp. (° C.) | t1 (s) | T1 (° C.) | S1 | Bar heater | Finish rolling end temp. (° C.) | Cooling rate (° C./s) | Coiling temp. (° C.) |
| Inv. ex. | D1 | A28 | 1130 | 10 | 1050 | 23078 | Yes | 960 | 22 | 570 |
| | D2 | A28 | 1320 | 13 | 1040 | 23053 | No | 920 | 17 | 540 |
| | D3 | A28 | 1270 | 8 | 950 | 21215 | No | 940 | 18 | 560 |
| | D4 | A28 | 1280 | 10 | 1020 | 22555 | No | 850 | 17 | 590 |
| | D5 | A28 | 1250 | 10 | 1040 | 22904 | Yes | 980 | 19 | 580 |
| | D6 | A28 | 1280 | 12 | 1040 | 23008 | No | 910 | 12 | 620 |
| | D7 | A28 | 1290 | 19 | 1020 | 22915 | No | 920 | 23 | 690 |
| | D8 | A28 | 1250 | 12 | 1020 | 22657 | No | 930 | 20 | 550 |
| | D9 | A28 | 1250 | 12 | 1020 | 22657 | No | 930 | 20 | 550 |
| | D10 | A28 | 1250 | 12 | 1020 | 22657 | No | 930 | 20 | 550 |

TABLE 5-continued

Table 4-1

| | | | | | | | | | |
|---|---|---|---|---|---|---|---|---|---|
| D11 | A28 | 1250 | 12 | 1020 | 22657 | No | 930 | 20 | 550 |
| D12 | A29 | 1130 | 10 | 1050 | 23078 | Yes | 960 | 22 | 570 |
| D13 | A29 | 1320 | 13 | 1040 | 23053 | No | 920 | 17 | 540 |
| D14 | A29 | 1270 | 8 | 950 | 21215 | No | 940 | 18 | 560 |
| D15 | A29 | 1280 | 10 | 1020 | 22555 | No | 850 | 17 | 590 |
| D16 | A29 | 1250 | 10 | 1040 | 22904 | Yes | 980 | 19 | 580 |
| D17 | A29 | 1280 | 12 | 1040 | 23008 | No | 910 | 12 | 620 |
| D18 | A29 | 1290 | 19 | 1020 | 22915 | No | 920 | 23 | 690 |
| D19 | A29 | 1250 | 12 | 1020 | 22657 | No | 930 | 20 | 550 |
| D20 | A29 | 1250 | 12 | 1020 | 22657 | No | 930 | 20 | 550 |
| D21 | A29 | 1250 | 12 | 1020 | 22657 | No | 930 | 20 | 550 |
| D22 | A29 | 1250 | 12 | 1020 | 22657 | No | 930 | 20 | 550 |

| | | | Pickling | | | | Steel sheet | |
|---|---|---|---|---|---|---|---|---|
| | No. | Steel no. | Acid | Conc. (%) | Temp. (° C.) | Time (s) | Cu surface concentration | Average crystal grain size (μm) |
| Inv. ex. | D1 | A28 | Hydrochloric | 12 | 90 | 30 | 1.3 | 21 |
| | D2 | A28 | Hydrochloric | 12 | 90 | 30 | 1.3 | 28 |
| | D3 | A28 | Hydrochloric | 12 | 90 | 30 | 1.2 | 22 |
| | D4 | A28 | Hydrochloric | 12 | 90 | 30 | 1.3 | 28 |
| | D5 | A28 | Hydrochloric | 12 | 90 | 30 | 1.3 | 27 |
| | D6 | A28 | Hydrochloric | 12 | 90 | 30 | 1.3 | 27 |
| | D7 | A28 | Hydrochloric | 12 | 90 | 30 | 1.2 | 28 |
| | D8 | A28 | Hydrochloric | 12 | 90 | 30 | 1.3 | 25 |
| | D9 | A28 | Sulfuric | 10 | 80 | 60 | 1.3 | 25 |
| | D10 | A28 | Hydrochloric | 8 | 90 | 30 | 1.5 | 25 |
| | D11 | A28 | Hydrochloric | 7 | 80 | 150 | 1.3 | 25 |
| | D12 | A29 | Hydrochloric | 12 | 90 | 30 | 1.4 | 22 |
| | D13 | A29 | Hydrochloric | 12 | 90 | 30 | 1.4 | 27 |
| | D14 | A29 | Hydrochloric | 12 | 90 | 30 | 1.3 | 21 |
| | D15 | A29 | Hydrochloric | 12 | 90 | 30 | 1.4 | 28 |
| | D16 | A29 | Hydrochloric | 12 | 90 | 30 | 1.4 | 27 |
| | D17 | A29 | Hydrochloric | 12 | 90 | 30 | 1.4 | 27 |
| | D18 | A29 | Hydrochloric | 12 | 90 | 30 | 1.3 | 28 |
| | D19 | A29 | Hydrochloric | 12 | 90 | 30 | 1.4 | 23 |
| | D20 | A29 | Sulfuric | 10 | 80 | 60 | 1.4 | 23 |
| | D21 | A29 | Hydrochloric | 8 | 90 | 30 | 1.6 | 23 |
| | D22 | A29 | Hydrochloric | 7 | 80 | 150 | 1.4 | 23 |

TABLE 6

Table 4-2

| | | | Hot rolling | | | | | | | |
|---|---|---|---|---|---|---|---|---|---|---|
| | No. | Steel no. | Slab heating temp. (° C.) | t1 (s) | T1 (° C.) | S1 | Bar heater | Finish rolling end temp. (° C.) | Cooling rate (° C./s) | Coiling temp. (° C.) |
| Comp. ex. | d1 | A28 | 1380 | 14 | 1030 | 22920 | No | 930 | 18 | 590 |
| | d2 | A28 | 1260 | 5 | 880 | 19765 | Yes | 940 | 16 | 600 |
| | d3 | A28 | 1260 | 5 | 800 | 18394 | Yes | 940 | 16 | 600 |
| | d4 | A28 | 1270 | 10 | 980 | 21857 | No | 750 | 17 | 610 |
| | d5 | A28 | 1250 | 12 | 960 | 21606 | Yes | 1100 | 15 | 590 |
| | d6 | A28 | 1260 | 14 | 960 | 21688 | No | 950 | 3 | 580 |
| | d7 | A28 | 1270 | 10 | 960 | 21508 | No | 940 | 19 | 850 |
| | d8 | A28 | 1270 | 10 | 960 | 21508 | No | 940 | 19 | 600 |
| | d9 | A28 | 1270 | 10 | 960 | 21508 | No | 940 | 19 | 600 |
| | d10 | A29 | 1380 | 14 | 1030 | 22920 | No | 930 | 18 | 590 |
| | d11 | A29 | 1260 | 5 | 880 | 19765 | Yes | 940 | 16 | 600 |
| | d12 | A29 | 1260 | 5 | 800 | 18394 | Yes | 940 | 16 | 600 |
| | d13 | A29 | 1270 | 5 | 980 | 21480 | No | 750 | 17 | 610 |
| | d14 | A29 | 1250 | 6 | 980 | 21579 | Yes | 1100 | 15 | 590 |
| | d15 | A29 | 1260 | 8 | 980 | 21736 | No | 950 | 3 | 580 |
| | d16 | A29 | 1270 | 8 | 980 | 21736 | No | 940 | 19 | 850 |
| | d17 | A29 | 1270 | 8 | 980 | 21736 | No | 940 | 19 | 600 |
| | d18 | A29 | 1270 | 8 | 980 | 21736 | No | 940 | 19 | 600 |

TABLE 6-continued

Table 4-2

| | No. | Steel no. | Pickling Acid | Conc. (%) | Temp. (° C.) | Time (s) | Steel sheet Cu surface concentration | Average crystal grain size (μm) |
|---|---|---|---|---|---|---|---|---|
| Comp. ex. | d1 | A28 | Hydrochloric | 12 | 90 | 30 | 1.3 | 92 |
| | d2 | A28 | Hydrochloric | 12 | 90 | 30 | 1.0 | 24 |
| | d3 | A28 | Hydrochloric | 12 | 90 | 30 | 0.7 | 23 |
| | d4 | A28 | Hydrochloric | 12 | 90 | 30 | 1.2 | 82 |
| | d5 | A28 | Hydrochloric | 12 | 90 | 30 | 1.2 | 80 |
| | d6 | A28 | Hydrochloric | 12 | 90 | 30 | 1.2 | 74 |
| | d7 | A28 | Hydrochloric | 12 | 90 | 30 | 1.2 | 75 |
| | d8 | A28 | Sulfuric | 15 | 80 | 180 | 0.9 | 24 |
| | d9 | A28 | Hydrochloric | 10 | 90 | 180 | 1.0 | 24 |
| | d10 | A29 | Hydrochloric | 12 | 90 | 30 | 1.3 | 78 |
| | d11 | A29 | Hydrochloric | 12 | 90 | 30 | 1.0 | 22 |
| | d12 | A29 | Hydrochloric | 12 | 90 | 30 | 0.8 | 21 |
| | d13 | A29 | Hydrochloric | 12 | 90 | 30 | 1.2 | 74 |
| | d14 | A29 | Hydrochloric | 12 | 90 | 30 | 1.2 | 76 |
| | d15 | A29 | Hydrochloric | 12 | 90 | 30 | 1.2 | 74 |
| | d16 | A29 | Hydrochloric | 12 | 90 | 30 | 1.2 | 75 |
| | d17 | A29 | Hydrochloric | 12 | 90 | 90 | 1.0 | 22 |
| | d18 | A29 | Hydrochloric | 10 | 90 | 180 | 1.1 | 22 |

Invention Examples D1 to D22 satisfying the scope of the present invention turned out to exhibit good degree of surface concentration of Cu and average crystal grain size, but Comparative Examples d1 to d18 not satisfying the scope of the present invention turned out to not satisfy at least one of the degree of surface concentration of Cu and average crystal grain size.

Example 4

Cold rolled steel sheet (thickness 1.8 mm) having the steel constituents of each of Steel Nos. A28 and A29 among the steel types shown in Table 1-1, having a degree of surface concentration of Cu of 1.2 or more, and having a crystal grain size of 30 μm or less was heat treated as shown in Table 5 to manufacture a steel member.

The results of evaluation of the structure and properties of the obtained steel member are shown in Table 5.

TABLE 7

Table 5

| | No. | Steel no. | Heat treatment Heating temp. T2 (° C.) | Rate of temp, rise (° C./s) | t2 (s) | S2 | Cooling rate to Ms (° C./s) | Ms to 100° C. cooling rate (° C./s) |
|---|---|---|---|---|---|---|---|---|
| Inv. ex. | E1 | A28 | 850 | 10 | 30 | 19946 | 95 | 50 |
| | E2 | A28 | 1080 | 12 | 20 | 23831 | 90 | 55 |
| | E3 | A28 | 990 | 7 | 30 | 22455 | 100 | 40 |
| | E4 | A28 | 870 | 500 | 40 | 20446 | 90 | 45 |
| | E5 | A28 | 900 | 8 | 20 | 20637 | 90 | 55 |
| | E6 | A28 | 920 | 10 | 30 | 21200 | 35 | 50 |
| | E7 | A28 | 910 | 9 | 40 | 21168 | 50 | 8 |
| | E8 | A28 | 920 | 10 | 100 | 21819 | 100 | 50 |
| | E9 | A28 | 920 | 10 | 90 | 21765 | 100 | 30 |
| | E10 | A29 | 850 | 10 | 50 | 20193 | 95 | 50 |
| | E11 | A29 | 1050 | 12 | 20 | 23299 | 90 | 55 |
| | E12 | A29 | 990 | 7 | 30 | 22455 | 100 | 40 |
| | E13 | A29 | 870 | 500 | 40 | 20446 | 90 | 45 |
| | E14 | A29 | 900 | 8 | 20 | 20637 | 90 | 55 |
| | E15 | A29 | 920 | 10 | 30 | 21200 | 35 | 50 |
| | E16 | A29 | 910 | 9 | 40 | 21168 | 50 | 8 |
| | E17 | A29 | 920 | 10 | 80 | 21704 | 100 | 50 |
| | E18 | A29 | 920 | 10 | 90 | 21765 | 100 | 25 |
| Comp. ex. | e1 | A28 | 810 | 10 | 10 | 18717 | 120 | 60 |
| | e2 | A28 | 1350 | 12 | 1 | 26524 | 85 | 50 |
| | e3 | A28 | 970 | 2 | 0.05 | 18671 | 100 | 45 |
| | e4 | A28 | 870 | 1500 | 1 | 18631 | 110 | 55 |
| | e5 | A28 | 870 | 9 | 1 | 18631 | 105 | 40 |

TABLE 7-continued

Table 5

| | | | | | | | |
|---|---|---|---|---|---|---|---|
| e6 | A28 | 870 | 9 | 0.1 | 17498 | 105 | 40 |
| e7 | A28 | 910 | 10 | 0.5 | 18935 | 5 | 50 |
| e8 | A28 | 960 | 8 | 0.1 | 18888 | 60 | 1 |
| e9 | A29 | 800 | 10 | 90 | 19557 | 120 | 60 |
| e10 | A29 | 1350 | 12 | 1 | 26524 | 85 | 50 |
| e11 | A29 | 980 | 2 | 30 | 22276 | 100 | 45 |
| e12 | A29 | 870 | 1500 | 20 | 20105 | 110 | 55 |
| e13 | A29 | 920 | 10 | 30 | 21200 | 5 | 50 |
| e14 | A29 | 980 | 8 | 30 | 22276 | 60 | 1 |

| | | | Steel member | | | | |
|---|---|---|---|---|---|---|---|
| | No. | Steel no. | Cu surfaces concentration | Tensile strength (MPa) | Impact value −40° C. (J/cm$^2$) | CCT Cycles | Critical hydrogen amount (ppm) |
| Inv. ex. | E1 | A28 | 1.5 | 1945 | 42 | 261 | 0.40 |
| | E2 | A28 | 1.7 | 1903 | 44 | 360 | 0.42 |
| | E3 | A28 | 1.7 | 1902 | 41 | 360 | 0.39 |
| | E4 | A28 | 1.5 | 1949 | 42 | 252 | 0.40 |
| | E5 | A28 | 1.4 | 1941 | 57 | 192 | 0.48 |
| | E6 | A28 | 1.5 | 1947 | 58 | 360 | 0.49 |
| | E7 | A28 | 1.5 | 1789 | 63 | 360 | 0.52 |
| | E8 | A28 | 1.5 | 1936 | 60 | 360 | 0.49 |
| | E9 | A28 | 1.5 | 1937 | 61 | 360 | 0.50 |
| | E10 | A29 | 1.6 | 2145 | 36 | 240 | 0.30 |
| | E11 | A29 | 1.8 | 2103 | 38 | 360 | 0.32 |
| | E12 | A29 | 1.8 | 2102 | 35 | 360 | 0.29 |
| | E13 | A29 | 1.6 | 2149 | 36 | 243 | 0.30 |
| | E14 | A29 | 1.5 | 2141 | 51 | 186 | 0.38 |
| | E15 | A29 | 1.6 | 2147 | 52 | 360 | 0.39 |
| | E16 | A29 | 1.6 | 1920 | 57 | 360 | 0.42 |
| | E17 | A29 | 1.6 | 2135 | 53 | 360 | 0.39 |
| | E18 | A29 | 1.6 | 2136 | 55 | 360 | 0.41 |
| Comp. ex. | e1 | A28 | 1.3 | 1646 | 28 | 102 | 0.39 |
| | e2 | A28 | 2.0 | 1867 | 26 | 330 | 0.38 |
| | e3 | A28 | 1.3 | 1901 | 28 | 96 | 0.36 |
| | e4 | A28 | 1.3 | 1953 | 27 | 93 | 0.37 |
| | e5 | A28 | 1.3 | 1945 | 48 | 90 | 0.38 |
| | e6 | A28 | 1.3 | 1940 | 49 | 88 | 0.36 |
| | e7 | A28 | 1.3 | 824 | 89 | 360 | 1.40 |
| | e8 | A28 | 1.3 | 1445 | 72 | 174 | 0.87 |
| | e9 | A29 | 1.5 | 1826 | 22 | 81 | 0.29 |
| | e10 | A29 | 2.1 | 2047 | 20 | 309 | 0.28 |
| | e11 | A29 | 1.7 | 2081 | 22 | 75 | 0.26 |
| | e12 | A29 | 1.6 | 2133 | 21 | 72 | 0.27 |
| | e13 | A29 | 1.6 | 1004 | 83 | 339 | 1.10 |
| | e14 | A29 | 1.7 | 1480 | 66 | 153 | 0.58 |

Invention Examples E1 to E18 satisfying the scope of the present invention turned out to be good in both structure and properties, but Comparative Examples e1 to e14 not satisfying the scope of the present invention turned out to not satisfy at least one of the structure and properties.

INDUSTRIAL APPLICABILITY

According to the present invention, it becomes possible to obtain a steel member and steel sheet excellent in hydrogen embrittlement resistance in a corrosive environment. The steel member according to the present invention is in particular suitable for use as a frame member of an automobile.

The invention claimed is:

1. A steel member, a chemical composition of the steel member comprising, by mass %, C: 0.25 to 0.60%, Si: 0.25 to 0.80%, Mn: 0.30 to 3.00%, P: 0.050% or less, S: 0.0100% or less, N: 0.010% or less, Ti: 0.010 to 0.100%, B: 0.0005 to 0.0100%, Cu: 0.15 to 1.00%, Mo: 0.10 to 1.00%, Cr: 0 to 1.00%, Ni: 0 to 1.00%, V: 0 to 1.00%, Ca: 0 to 0.010%, Al: 0 to 1.00%, Nb: 0 to 0.10%, Sn: 0 to 1.00%, W: 0 to 1.00%, Sb: 0 to 1.00%, REMs: 0 to 0.30%, and bal.: Fe and impurities, a maximum value of the content, by mass %, of Cu in a range of a depth from the surface of 0 to 30 μm being 1.4 times or more of the content of Cu at a depth of 200 μm.

2. A steel sheet, a chemical composition of the steel sheet comprising, by mass %, C: 0.25 to 0.60%, Si: 0.25 to 0.80%, Mn: 0.30 to 3.00%, P: 0.050% or less, S: 0.0100% or less, N: 0.010% or less, Ti: 0.010 to 0.100%, B: 0.0005 to 0.0100%, Cu: 0.15 to 1.00%, Mo: 0.10 to 1.00%, Cr: 0 to 1.00%, Ni: 0 to 1.00%, V: 0 to 1.00%, Ca: 0 to 0.010%, Al: 0 to 1.00%, Nb: 0 to 0.10%, Sn: 0 to 1.00%, W: 0 to 1.00%, Sb: 0 to 1.00%, REMs: 0 to 0.30%, and bal.: Fe and impurities, a maximum value of the content, by mass %, of Cu in a range of a depth from the surface of 0 to 30 μm being 1.2 times or more of the content of Cu at a depth of 200 μm, an average crystal grain size being 30 μm or less.

3. A method for manufacturing the steel member according to claim 1, the method comprising the steps of:

heating the steel sheet according to claim 2 under conditions of a peak temperature of T2(° C.) and a time from when a temperature of the steel sheet reaches a temperature 10° C. lower than T2 (° C.) until heating ends of t2 (hr) satisfying, $(T2+273-10)\times(\log t2+20)\geq 19000$, $Ac_3$ point$\leq T2\leq(Ac_3$ point$+300)$ ° C. and an average rate of temperature rise of 5 to 1000° C./s;

cooling the heated steel sheet down to an Ms point by an upper critical cooling rate or more; and cooling from the Ms point to 100° C. or less by an average cooling rate of 5° C./s or more, thereby producing the steel member of claim 1.

4. The method according to claim 3, wherein the steel sheet is hot shaped during cooling the steel sheet down to the Ms point.

5. A method for manufacturing the steel sheet according to claim 2, the method comprising the steps of:

heating a slab having constituents described in claim 2 to 1100 to 1350° C., hot rolling the heated slab to obtain a hot rolled steel sheet under conditions of a time t1 (hr) from the end of rough rolling to the start of finish rolling and an average temperature T1 (° C.) of a rough bar from the end of rough rolling to the start of finish rolling satisfying $(T1+273)\times(\log t1+20)\geq 20000$ and a finish rolling end temperature of an $Ar_3$ point to 1000° C., cooling the hot rolled steel sheet by an average cooling rate of 10° C./s or more, coiling the steel sheet after cooling at 700° C. or less, and pickling the steel sheet after coiling, thereby producing the steel sheet of claim 2.

6. The method according to claim 5, wherein in the step of pickling, hydrochloric acid or sulfuric acid is used, a pickling temperature is 80 to 90° C., and an acid concentration α (%) and pickling time "t" (s) satisfy $$6\leq\alpha<14,$$

$$0<t\leq 420-30\times\alpha.$$

* * * * *